US010466622B2

(12) United States Patent
Minoshima et al.

(10) Patent No.: US 10,466,622 B2
(45) Date of Patent: Nov. 5, 2019

(54) PROCESS UNIT INCLUDING MAIN UNIT AND TONER CARTRIDGE INCLUDING TONER SUPPLY PIPE AND SHUTTER

(71) Applicant: BROTHER KOGYO KABUSHIKI KAISHA, Nagoya-shi, Aichi-ken (JP)

(72) Inventors: Saya Minoshima, Gifu (JP); Shougo Sato, Seto (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/242,504

(22) Filed: Jan. 8, 2019

(65) Prior Publication Data

US 2019/0137906 A1 May 9, 2019

Related U.S. Application Data

(63) Continuation of application No. 15/889,460, filed on Feb. 6, 2018, now Pat. No. 10,216,118.

(30) Foreign Application Priority Data

Mar. 31, 2017 (JP) ..... 2017-071034

(51) Int. Cl.
*G03G 15/08* (2006.01)
*G03G 21/18* (2006.01)

(52) U.S. Cl.
CPC ..... *G03G 15/0886* (2013.01); *G03G 15/0806* (2013.01); *G03G 21/1814* (2013.01); *G03G 15/0844* (2013.01)

(58) Field of Classification Search
CPC ..... G03G 15/0886; G03G 15/0865; G03G 15/0881; G03G 15/0898; G03G 21/1814; G03G 21/1817
USPC ..... 399/106, 111, 113, 258, 260, 262
See application file for complete search history.

(56) References Cited

U.S. PATENT DOCUMENTS

| | | | |
|---|---|---|---|
| 9,342,035 | B2 | 5/2016 | Sato |
| 9,904,211 | B2 | 2/2018 | Sato |
| 10,216,118 | B2 * | 2/2019 | Minoshinna et al. ..... G03G 21/1814 |
| 2016/0109827 | A1 | 4/2016 | Yoshida et al. |

FOREIGN PATENT DOCUMENTS

JP 2014-232270 A 12/2014

* cited by examiner

*Primary Examiner* — William J Royer
(74) *Attorney, Agent, or Firm* — Merchant & Gould P.C.

(57) ABSTRACT

A toner cartridge includes a toner supply pipe and a first shutter. The toner supply pipe has a toner supply opening. When the toner cartridge is mounted onto a main unit, the toner supply pipe moves through an insertion opening from an outside position at which the toner supply opening is located outside a developing frame to an inside position at which the toner supply opening is located inside the developing frame. The first shutter is provided at the toner supply pipe. The first shutter moves relative to the toner supply pipe between an open position at which the toner supply opening is opened and a closed position at which the toner supply opening is closed. The first shutter moves relative to the toner supply pipe from the closed position to the open position in a state where the toner supply pipe is located at the inside position.

17 Claims, 15 Drawing Sheets

PROCESS UNIT INCLUDING MAIN UNIT AND TONER CARTRIDGE INCLUDING TONER SUPPLY PIPE AND SHUTTER

CROSS REFERENCE TO RELATED APPLICATIONS

This application is a continuation of U.S. patent application Ser. No. 15/889,460, filed Feb. 6, 2018, which further claims priority from Japanese Patent Application No. 2017-071034 filed Mar. 31, 2017. The entire contents of both applications are incorporated herein by reference.

TECHNICAL FIELD

This disclosure relates to a process unit.

BACKGROUND

Conventionally, a process unit having a main unit and a toner cartridge mountable on the main unit is known.

A main unit includes a photosensitive drum and a developing unit. The developing unit includes a developing roller. The developing unit has an opening for receiving a toner supplied from a toner cartridge. The toner cartridge has an opening for discharging a toner in the inside. The opening of the toner cartridge faces the opening of the developing unit in a state where the toner cartridge is mounted on the main unit. The toner cartridge includes a shutter that is movable between an open position in which the opening is opened, and a closed position in which the opening is closed. The shutter is moved between the open position and the closed position by operation by a user, in a state where the toner cartridge is mounted on the main unit.

SUMMARY

According to one aspect, this specification discloses a process unit. The process unit includes a main unit and a toner cartridge. The main unit includes a drum unit and a developing unit. The drum unit has a photosensitive drum. The developing unit has a developing roller and a developing frame supporting the developing roller. The developing frame has an insertion opening. The toner cartridge is configured to be mounted on the main unit. The toner cartridge includes a toner supply pipe and a first shutter. The toner supply pipe has a toner supply opening. The toner supply pipe is configured to, when the toner cartridge is mounted onto the main unit, move through the insertion opening from an outside position at which the toner supply opening is located outside the developing frame to an inside position at which the toner supply opening is located inside the developing frame. The first shutter is provided at the toner supply pipe. The first shutter is configured to move relative to the toner supply pipe between an open position at which the toner supply opening is opened and a closed position at which the toner supply opening is closed. The first shutter is configured to move relative to the toner supply pipe from the closed position to the open position in a state where the toner supply pipe is located at the inside position.

BRIEF DESCRIPTION OF THE DRAWINGS

Embodiments in accordance with this disclosure will be described in detail with reference to the following figures wherein.

DETAILED DESCRIPTION

In the process unit described above, there is a problem that, when a shutter moves, a part of a toner discharged from an opening of a toner cartridge is not received by an opening of a developing unit, and stains the developing unit.

An example of the object of this disclosure is to provide a process unit that prevents a developing unit from being stained when a toner cartridge is mounted on a main unit.

1. Outline of Process Unit

The outline of a process unit 1 will be described.

Figure 1:
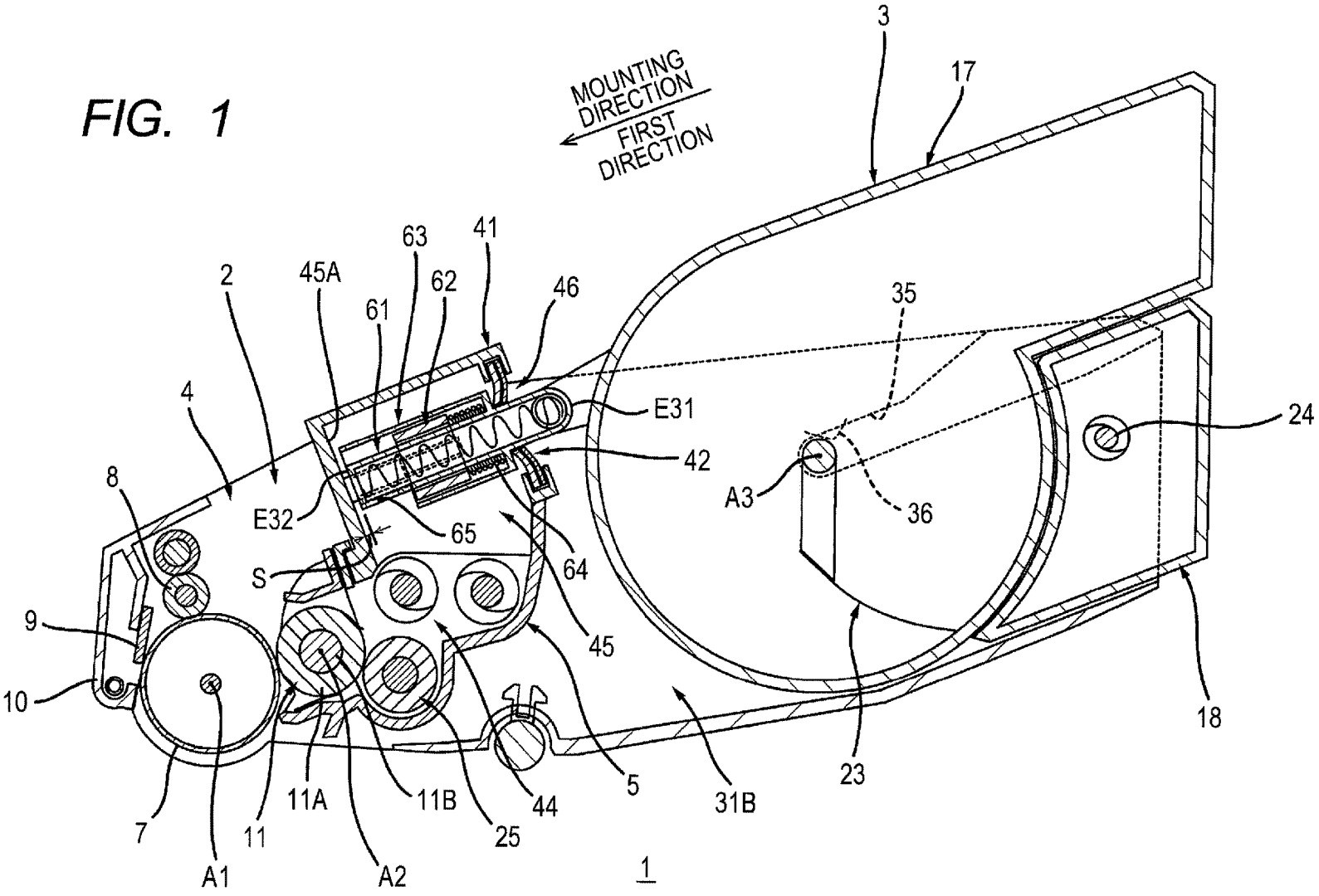
FIG. 1 is a cross-sectional view of a process unit of this disclosure, and is a cross-sectional view taken along line C-C of FIG. 7.

As shown in FIG. 1, the process unit 1 includes a main unit 2, and a toner cartridge 3. The toner cartridge 3 is mountable on the main unit 2. The toner cartridge 3 is detachable from the main unit 2.

Figure 2:
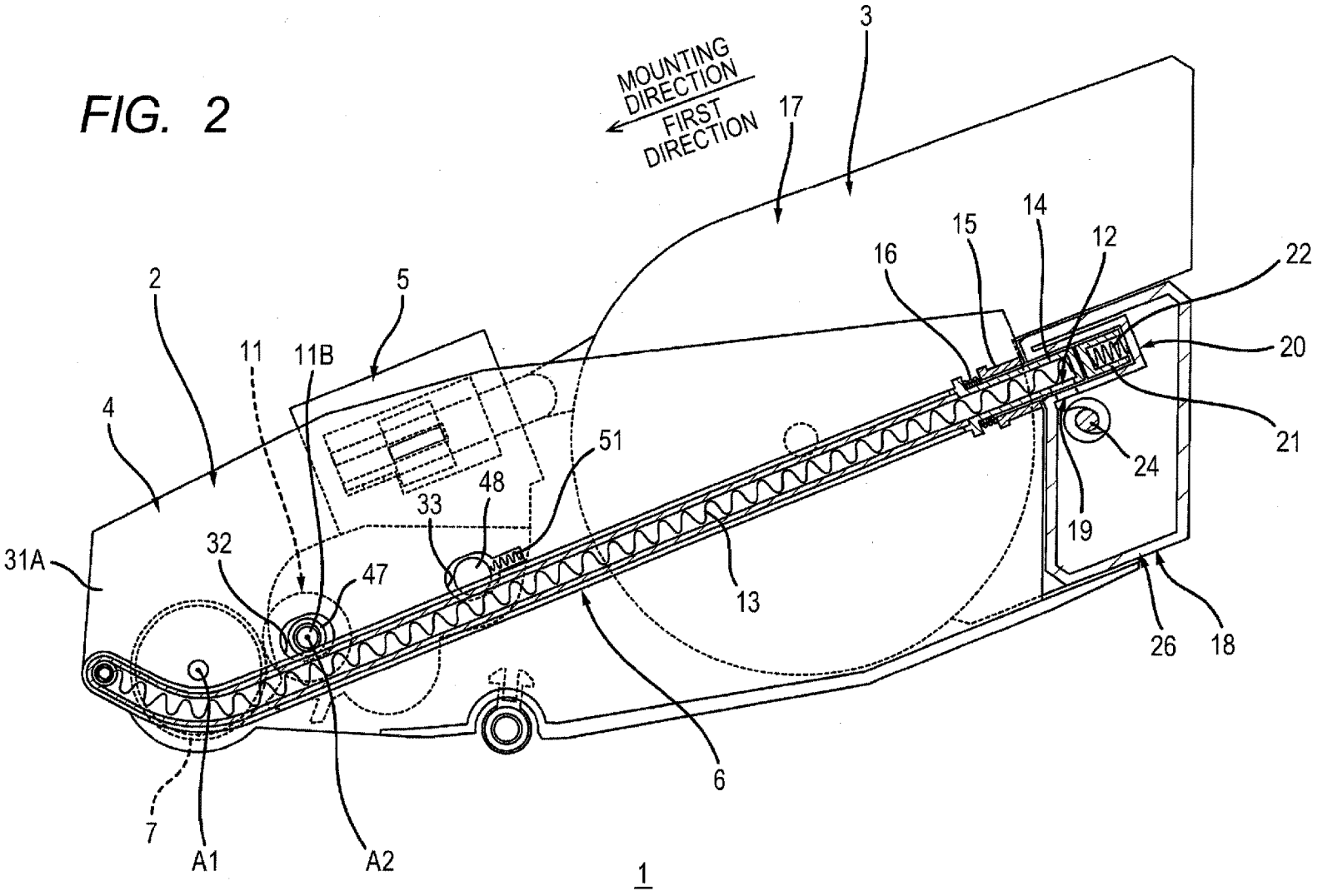
FIG. 2 is a side view of the process unit shown in FIG. 1, wherein in order to illustrate the insides of a toner recovery pipe and a toner recovery box, the toner recovery pipe and the toner recovery box are shown as a cross section taken along line A-A shown in FIG. 4.

The main unit 2 includes a drum unit 4, a developing unit 5, and a toner recovery pipe 6 (see FIG. 2).

1.1 Drum Unit

The drum unit 4 includes a photosensitive drum 7, a charging roller 8, a cleaner 9, and a cleaning frame 10.

The photosensitive drum 7 is configured so that a toner image is formed on a surface of the photosensitive drum 7. The photosensitive drum 7 is configured to rotate about a rotation axis A1 extending in an axial direction.

The charging roller 8 is configured to charge the surface of the photosensitive drum 7. The charging roller 8 contacts the surface of the photosensitive drum 7.

The cleaner 9 is configured to remove a toner from the photosensitive drum 7. The cleaner 9 contacts the surface of the photosensitive drum 7. The cleaner 9 extends in the axial direction. The cleaner 9 has a plate shape.

The cleaning frame 10 accommodates the toner removed from the photosensitive drum 7 by the cleaner 9.

1.2 Developing Unit

The developing unit 5 is configured to supply the toner supplied from the toner cartridge 3, to the photosensitive drum 7. The detailed configuration of the developing unit 5 will be described later. The developing unit 5 includes a developing roller 11 and a supply roller 25.

The developing roller 11 is configured to supply the toner in the developing unit 5 to the photosensitive drum 7. The developing roller 11 contacts the surface of the photosensitive drum 7. The developing roller 11 may be in proximity to a circumferential surface of the photosensitive drum 7 with a space therebetween. The developing roller 11 is configured to rotate about a rotation axis A2 extending in the axial direction. Specifically, the developing roller 11 includes a roller body 11A and a shaft 11B.

The roller body 11A extends in the axial direction. The roller body 11A is formed of a conductive rubber. The roller body 11A has a columnar shape. The roller body 11A contacts the surface of the photosensitive drum 7. In a case where the developing roller 11 is in proximity to the circumferential surface of the photosensitive drum 7 with a space therebetween, the roller body 11A is in proximity to the circumferential surface of the photosensitive drum 7 with a space therebetween.

The shaft 11B extends along the rotation axis A2 of the developing roller 11. The shaft 11B is formed of a metal.

The supply roller 25 is configured to supply the toner in the developing unit 5 to the developing roller 11. The supply roller 25 contacts a circumferential surface of the developing roller 11.

1.3 Toner Recovery Pipe

As shown in FIG. 2, the toner recovery pipe 6 recovers the toner from the cleaning frame 10 (see FIG. 1) into a toner recovery box 18 described later. The toner recovery pipe 6 has a toner discharge opening 12. Specifically, the toner recovery pipe 6 includes a screw 13, an insertion cylinder 14 having the toner discharge opening 12, a shutter 15, and a spring 16.

The screw 13 is configured to convey the toner from the cleaning frame 10 to the toner recovery box 18. The screw 13 is located inside the cleaning frame 10 (see FIG. 4) and the toner recovery pipe 6.

The insertion cylinder 14 is inserted in a receiving cylinder 20 of the toner cartridge 3 described later in a state where the toner cartridge 3 is mounted on the main unit 2. The direction in which the insertion cylinder 14 is inserted in the receiving cylinder 20 is parallel to a first direction described later. Thereby, when the toner cartridge 3 is mounted onto the main unit 2, the toner cartridge 3 is moved in the first direction with respect to the main unit 2, and thereby, a toner supply pipe 61 (see FIG. 1) described later is inserted in an insertion opening 46 (see FIG. 1) described later, and the insertion cylinder 14 is inserted in the receiving cylinder 20. Thereby, the toner cartridge 3 is smoothly mounted onto the main unit 2. The toner discharge opening 12 communicates with a toner recovery opening 19 described later, in a state where the toner cartridge 3 is mounted on the main unit 2. In this state, the toner discharge opening 12 discharges the toner conveyed by the screw 13. The toner discharged from the toner discharge opening 12 is accommodated in the toner recovery box 18 through the toner recovery opening 19.

The shutter 15 is movable relative to the insertion cylinder 14 between an open position (see FIG. 2) at which the toner discharge opening 12 is opened, and a closed position (see FIG. 4) at which the toner discharge opening 12 is closed. The shutter 15 is located at an outer surface of the insertion cylinder 14. When the toner cartridge 3 is mounted onto the main unit 2, the shutter 15 abuts the toner recovery box 18 in the mounting direction of the toner cartridge 3 relative to the main unit 2, thereby moving from the closed position to the open position relative to the insertion cylinder 14. When the toner cartridge 3 is detached from the main unit 2, the shutter 15 is pressed by the spring 16, thereby moving from the open position to the closed position with respect to the insertion cylinder 14.

The spring 16 is configured to press the shutter 15 located at the open position toward the closed position. The spring 16 contacts the shutter 15.

1.4 Toner Cartridge

As shown in FIG. 1, the toner cartridge 3 is configured to supply the toner to the developing unit 5. The detailed configuration of the toner cartridge 3 will be described later. The toner cartridge 3 includes a toner accommodation box 17, an agitator 23, the toner recovery box 18, and an auger screw 24.

In the toner accommodation box 17, the toner supplied to the developing unit 5 is accommodated.

The agitator 23 is configured to agitate the toner in the toner accommodation box 17. The agitator 23 is configured to supply the toner in the toner accommodation box 17 to the toner supply pipe 61 described later. The agitator 23 is located in the toner accommodation box 17. The agitator 23 is configured to rotate about a rotation axis A3 extending in the axial direction.

Figure 7:
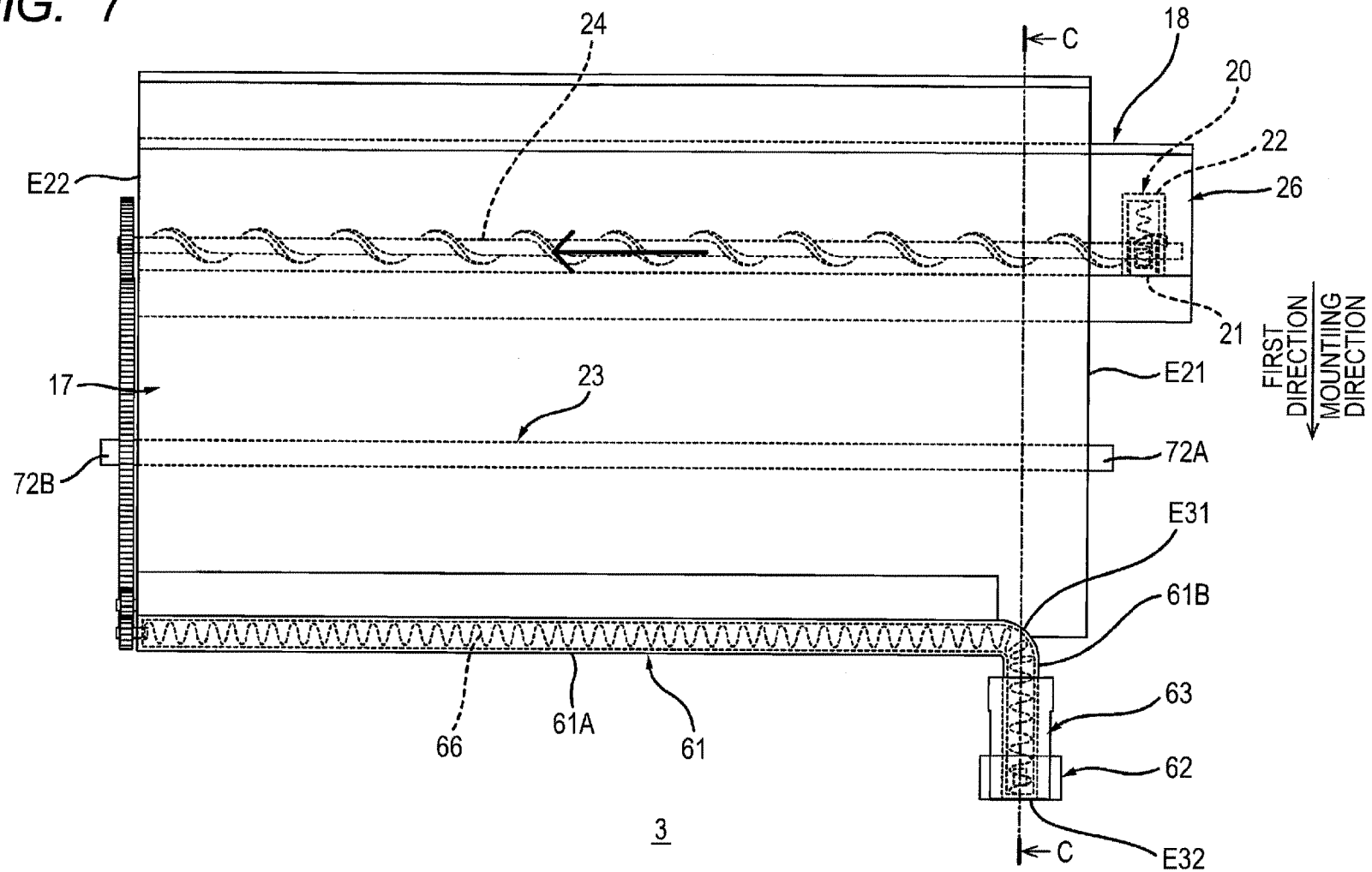
FIG. 7 is a plan view of a toner cartridge shown in FIG. 1.

The toner accommodated in the cleaning frame 10 is recovered into the toner recovery box 18. Specifically, as shown in FIG. 2, the toner recovery box 18 accommodates the toner conveyed by the toner recovery pipe 6. The toner recovery box 18 has the toner recovery opening 19. Specifically, as shown in FIG. 7, the length of the toner recovery box 18 in the axial direction is longer than the length of the toner accommodation box 17 in the axial direction. The toner recovery box 18 has a protruding portion 26 protruding farther than the toner accommodation box 17 in the axial direction. As shown in FIG. 2, the protruding portion 26 includes: the receiving cylinder 20 having the toner recovery opening 19; a shutter 21; and a spring 22.

The receiving cylinder 20 receives the insertion cylinder 14 of the toner recovery pipe 6, in a state where the toner cartridge 3 is mounted on the main unit 2.

The shutter 21 is movable relative to the receiving cylinder 20 between an open position (see FIG. 2) at which the toner recovery opening 19 is opened, and a closed position (see FIG. 7) at which the toner recovery opening 19 is closed. The shutter 21 is located inside the receiving cylinder 20. When the toner cartridge 3 is mounted onto the main unit 2, the shutter 21 is pressed by the insertion cylinder 14, thereby moving from the closed position to the open position relative to the receiving cylinder 20. When the toner cartridge 3 is detached from the main unit 2, the shutter 21 is pressed by the spring 22, thereby moving from the open position to the closed position relative to the receiving cylinder 20.

The spring 22 is configured to press the shutter 21 located at the open position toward the closed position. The spring 22 contacts the shutter 21.

As shown in FIG. 7, the auger screw 24 is configured to convey the toner in the toner recovery box 18 in the axial direction. Specifically, the auger screw 24 is configured to convey the toner in the toner recovery box 18 toward a direction away from the toner recovery opening 19, in the axial direction. The auger screw 24 is located in the toner recovery box 18. The auger screw 24 extends in the axial direction.

2. Detail of Process Unit 1

Detail of the process unit 1 will be described below.

As shown in FIG. 1, the toner cartridge 3 includes the toner supply pipe 61 for supplying the toner to the developing unit 5, and a first shutter 62. The toner supply pipe 61 has a toner supply opening 65. The first shutter 62 is movable relative to the toner supply pipe 61 between an open position (see FIG. 1) at which the toner supply opening 65 is opened, and a closed position (see FIG. 3) at which the toner supply opening 65 is closed.

The developing unit 5 includes a developing frame 41 having the insertion opening 46. When the toner cartridge 3 is mounted onto the main unit 2, the toner supply pipe 61 is inserted in the insertion opening 46. Specifically, when the toner cartridge 3 is mounted onto the main unit 2, the toner supply pipe 61 moves relative to the developing frame 41 from an outside position (see FIG. 8A) at which the toner supply opening 65 is located outside the developing frame 41 to an inside position (see FIG. 1 and FIG. 3) at which the toner supply opening 65 is located inside the developing frame 41, through the insertion opening 46. The first direction in which the toner supply pipe 61 moves from the outside position to the inside position is the same direction as the mounting direction of the toner cartridge 3 onto the main unit 2.

Figure 3:
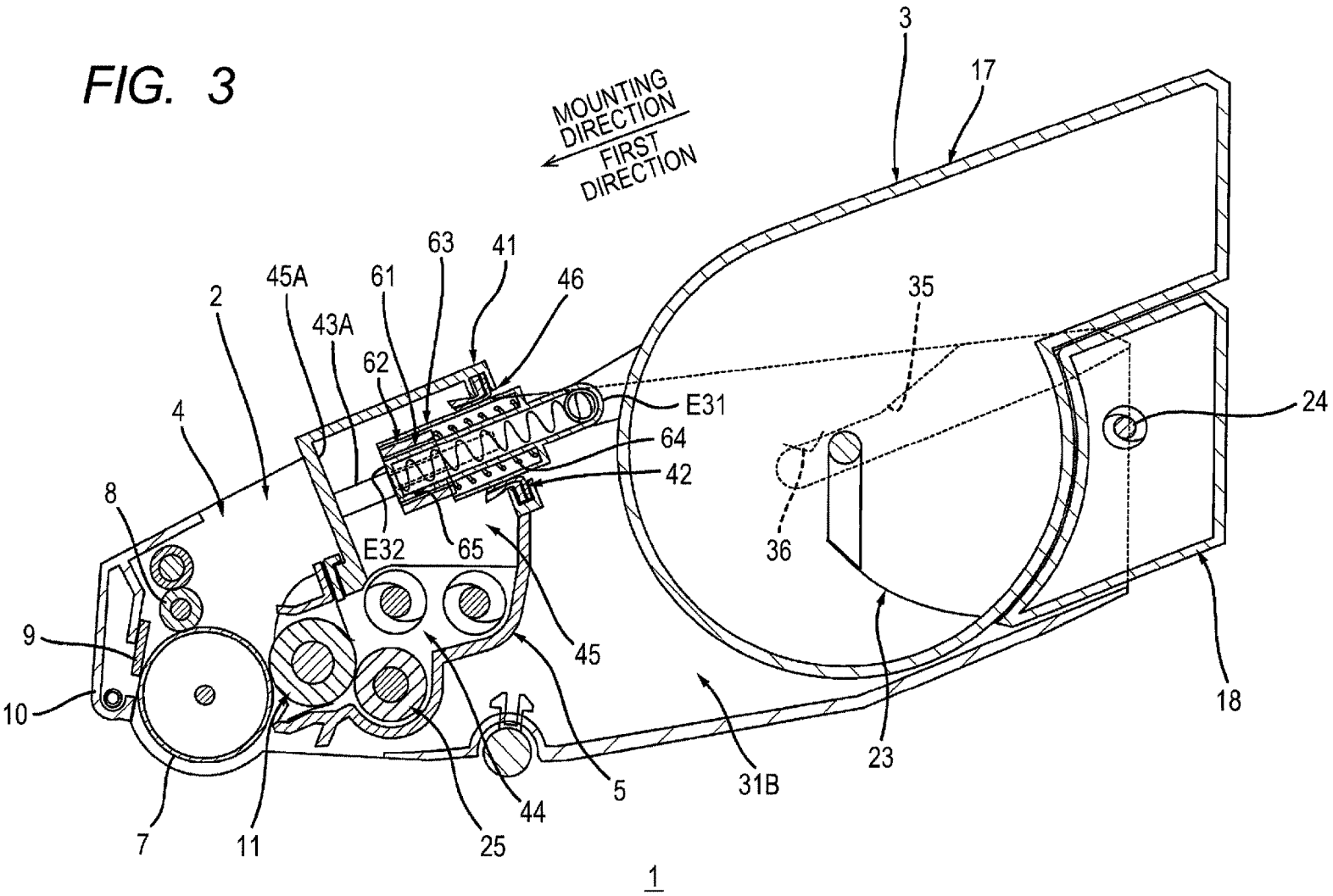
FIG. 3 is an explanatory diagram for explaining opening and closing operation of a first shutter shown in FIG. 1, and shows a state where a toner supply pipe is located at an inside position and the first shutter is located at a closed position.

At this time, as shown in FIG. 1 and FIG. 3, the first shutter 62 moves relative to the toner supply pipe 61 from an closed position (see FIG. 3) to an open position (see FIG. 1) in a state where the toner supply pipe 61 is located at the inside position.

The detailed structures of the drum unit 4, the developing unit 5, and the toner cartridge 3 will be described below.

2.1 Drum Unit

Figure 4:
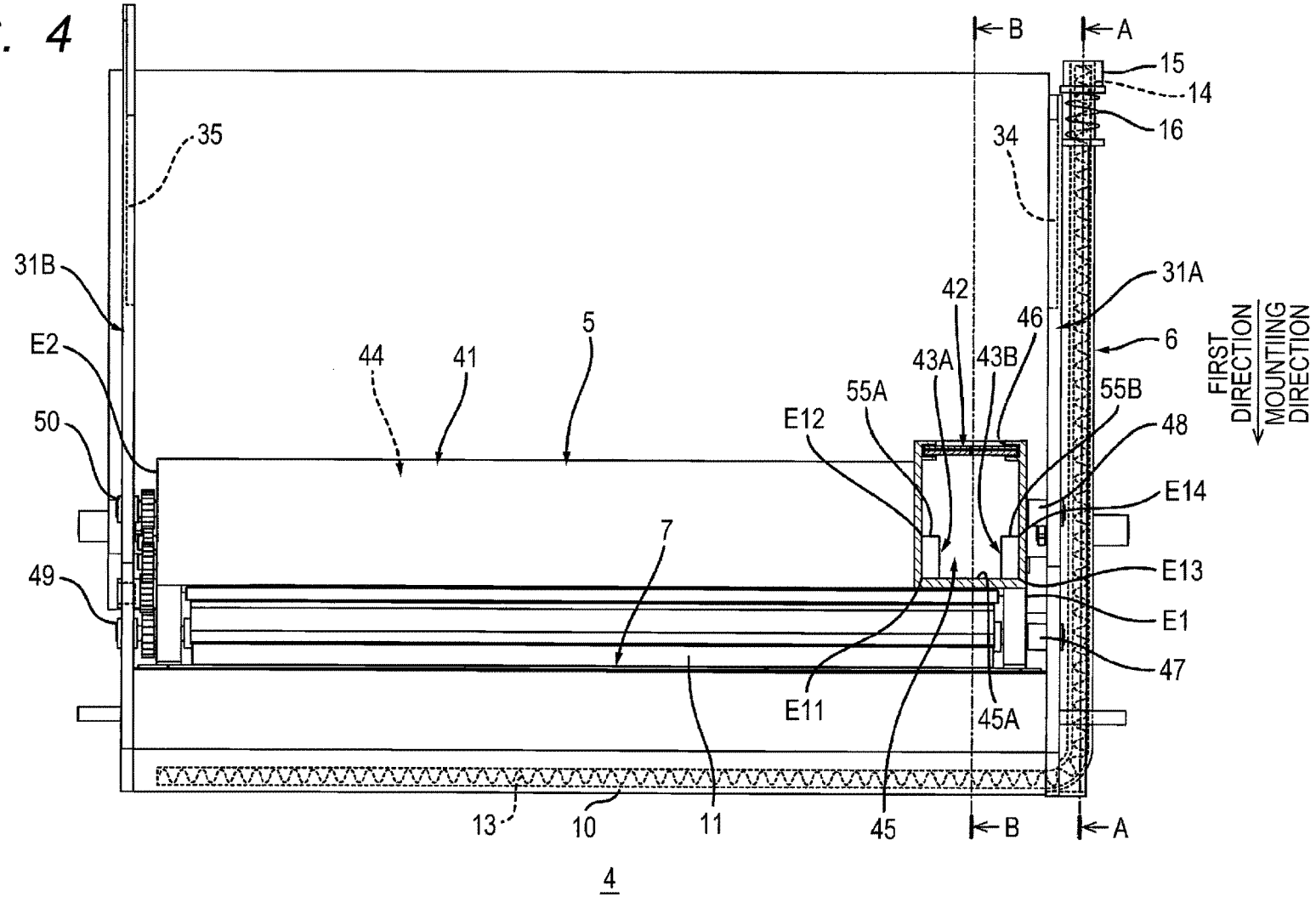
FIG. 4 is a plan view of a main unit shown in FIG. 1, wherein in order to illustrate an inside of an insertion space, a part of a developing frame is shown as a cross section.

As shown in FIG. 4, the drum unit 4 includes a drum side plate 31A and a drum side plate 31B.

The drum side plate 31A, together with the drum side plate 31B, supports the photosensitive drum 7 (see FIG. 2) and the developing unit 5. The drum side plate 31A supports the toner recovery pipe 6. The drum side plate 31A is located between the toner recovery pipe 6 and the developing unit 5 in the axial direction. The toner recovery pipe 6 is attached to the drum side plate 31A. The drum side plate 31A extends in a direction perpendicular to the axial direction. The drum side plate 31A has a first elongated hole 32 (see FIG. 2), a second elongated hole 33 (see FIG. 2), a guide 34, and a positioning protrusion (not shown). That is, the drum unit 4 has the first elongated hole 32.

As shown in FIG. 2, a first boss 47 of the developing unit 5 described later is inserted in the first elongated hole 32. The first elongated hole 32 extends in a direction toward the photosensitive drum 7 or away from the photosensitive drum 7 in a direction perpendicular to the axial direction. More specifically, the first elongated hole 32 extends in the mounting direction. That is, the first elongated hole 32 extends in parallel to the first direction.

A second boss 48 of the developing unit 5 described later is inserted in the second elongated hole 33. The second elongated hole 33 is located at the opposite side of the photosensitive drum 7 with respect to the first elongated hole 32, in the mounting direction. The second elongated hole 33 extends in the same direction as the first elongated hole 32.

As shown in FIG. 4, when the toner cartridge 3 is mounted onto the main unit 2, the guide 34 guides the toner cartridge 3, together with a guide 35 of the drum side plate 31B described later. That is, the toner cartridge 3 is mountable onto the main unit 2 in a direction in which the guide 34 extends. The guide 34 extends in the mounting direction. A boss 72A (see FIG. 7) of the toner cartridge 3 described later is fitted into the guide 34.

The positioning protrusion (not shown) engages the boss 72A (see FIG. 7) of the toner cartridge 3 described later, thereby positioning the toner cartridge 3 with respect to the main unit 2. The positioning protrusion (not shown) is located in the guide 34. The positioning protrusion (not shown) is located at a downstream end of the guide 34 in the mounting direction of the toner cartridge 3 onto the main unit 2. The positioning protrusion (not shown) is formed of a leaf spring, as similar to a positioning protrusion 36 (see FIG. 1) described later.

The drum side plate 31B is located with a space with respect to the drum side plate 31A in the axial direction. The drum side plate 31B is located at the opposite side of the drum side plate 31A with respect to the photosensitive drum 7 and the developing unit 5, in the axial direction. The drum side plate 31B extends in a direction perpendicular to the axial direction. The drum side plate 31B has a third elongated hole (not shown), a fourth elongated hole (not shown), the guide 35, and the positioning protrusion 36 (see FIG. 1).

A third boss 49 of the developing unit 5 described later is inserted into the third elongated hole. The third elongated hole is located at the opposite side of the first elongated hole 32 (see FIG. 2) with respect to the developing frame 41 described later, in the axial direction. The third elongated hole extends in the same direction as the first elongated hole 32.

A fourth boss 50 of the developing unit 5 described later is inserted into the fourth elongated hole. The fourth elongated hole is located at the opposite side of the photosensitive drum 7 with respect to the third elongated hole in the mounting direction. The fourth elongated hole is located at the opposite side of the second elongated hole 33 (see FIG. 2) with respect to the developing frame 41 described later, in the axial direction. The fourth elongated hole extends in the same direction as the first elongated hole 32.

When the toner cartridge 3 is mounted onto the main unit 2, the guide 35 guides the toner cartridge 3, together with the guide 34 of the drum side plate 31A. The guide 35 extends in the mounting direction. A boss 72B (see FIG. 7) of the toner cartridge 3 described later is fitted into the guide 35.

As shown in FIG. 1, the positioning protrusion 36 engages the boss 72B (see FIG. 7) of the toner cartridge 3 described later, thereby positioning the toner cartridge 3 with respect to the main unit 2. The positioning protrusion 36 is located at the guide 35. The positioning protrusion 36 is located at a downstream end of the guide 35 in the mounting direction of the toner cartridge 3 onto the main unit 2. The positioning protrusion 36 is formed of a leaf spring.

2.2 Developing Unit

As shown in FIG. 4, the developing unit 5 is located between the drum side plate 31A and the drum side plate 31B in the axial direction. The developing unit 5 includes the developing frame 41, a seal member 42, a protrusion 43A, a protrusion 43B, an auger screw 52A (see FIG. 5), and an auger screw 52B (see FIG. 5).

2.2.1 Developing Frame

The developing frame 41 is a frame of the developing unit 5. The developing frame 41 supports the developing roller 11. The developing frame 41 extends in the axial direction. The developing frame 41 has a one end E1 and an other end E2 located away from the one end E1 in the axial direction. The one end E1 is located closer to the drum side plate 31A than to the drum side plate 31B in the axial direction. The one end E1 faces the drum side plate 31A. The other end E2 is located closer to the drum side plate 31B than to the drum side plate 31A in the axial direction. The other end E2 faces the drum side plate 31B. The developing frame 41 includes the first boss 47, the second boss 48, the third boss 49, and the fourth boss 50.

The first boss 47 is located at the one end E1 of the developing frame 41. As shown in FIG. 2, the first boss 47 is inserted in the first elongated hole 32 of the drum unit 4. One end of the shaft 11B of the developing roller 11 is inserted in the first boss 47. The shaft 11B is configured to rotate relative to the first boss 47. The first boss 47 extends along the rotation axis A2 of the developing roller 11. The first boss 47 has a cylindrical shape.

The second boss 48 is located at the one end E1 (see FIG. 4) of the developing frame 41. The second boss 48 is inserted in the second elongated hole 33 of the drum unit 4. The second boss 48 is located at the opposite side of the photosensitive drum 7 with respect to the first boss 47 in the mounting direction. The second boss 48 extends in the axial direction. The second boss 48 has a cylindrical shape. The second boss 48 is pressed toward the photosensitive drum 7 by a spring 51 in the mounting direction.

As shown in FIG. 4, the third boss 49 is located at the other end E2 of the developing frame 41. The third boss 49 is inserted in the third elongated hole (not shown) of the drum unit 4. An other end of the shaft 11B of the developing roller 11 is inserted in the third boss 49. The shaft 11B is configured to rotate relative to the third boss 49. The third boss 49 extends along the rotation axis A2 (see FIG. 2) of the developing roller 11. The third boss 49 has a cylindrical shape.

The fourth boss 50 is located at the other end E2 of the developing frame 41. The fourth boss 50 is inserted in the fourth elongated hole (not shown) of the drum unit 4. The fourth boss 50 is located at the opposite side of the photosensitive drum 7 (see FIG. 2) with respect to the third boss 49 in the mounting direction. The fourth boss 50 extends in the axial direction. The fourth boss 50 has a cylindrical shape. The fourth boss 50 is pressed toward the photosensitive drum 7 by the spring (not shown) in the mounting direction.

The first boss 47 is inserted in the first elongated hole 32, the second boss 48 is inserted in the second elongated hole 33, the third boss 49 is inserted in the third elongated hole, and the fourth boss 50 is inserted in the fourth elongated hole. Thereby, the developing unit 5 is movable relative to the photosensitive drum 7 in the mounting direction.

The second boss 48 is pressed by the spring 51, and the fourth boss 50 is pressed by a spring (not shown), and thereby, the developing unit 5 is pressed against the photosensitive drum 7 in the mounting direction.

Figure 6A:
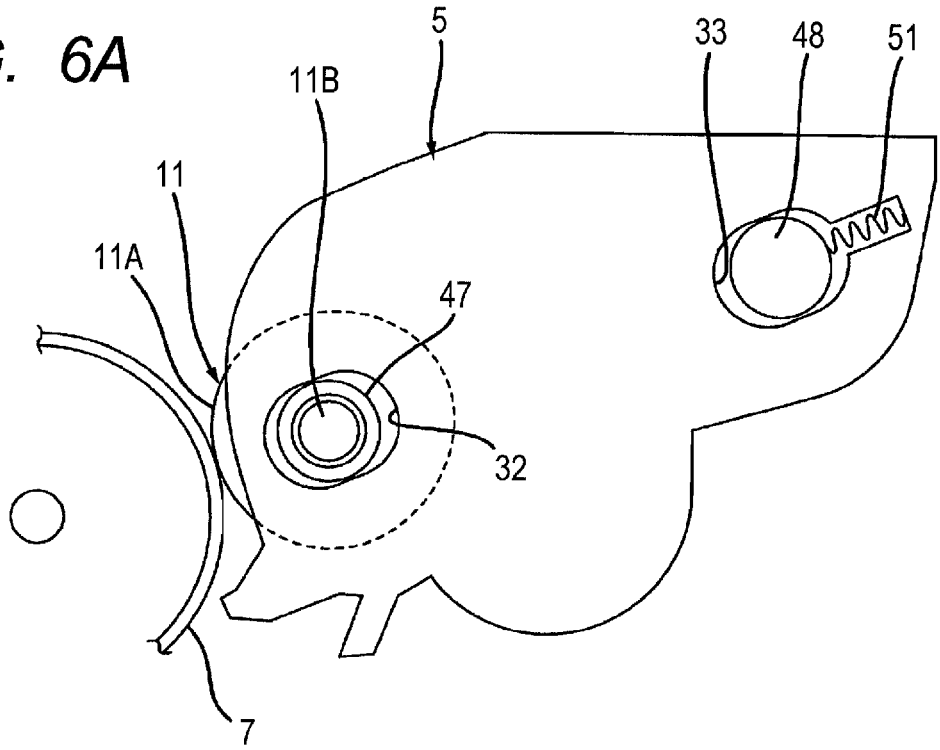
FIG. 6A is an explanatory diagram for explaining movement of a developing unit with respect to a photosensitive drum, and shows a state where a developing roller is still.
Figure 6B:
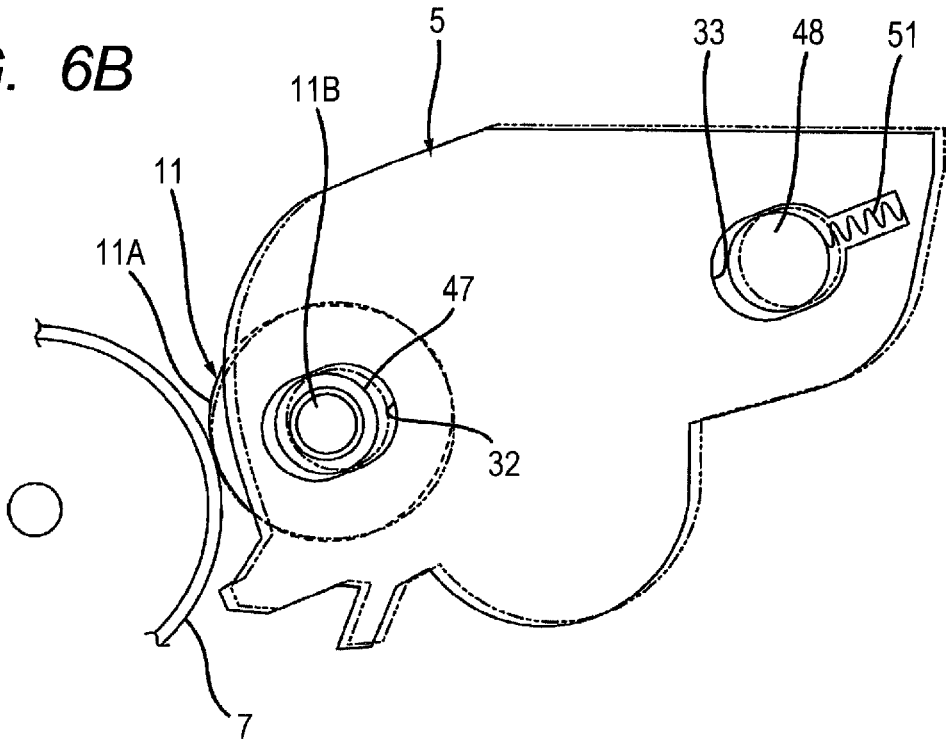
FIG. 6B is an explanatory diagram for explaining movement of the developing unit with respect to the photosensitive drum, together with FIG. 6A, and shows a state where the developing roller is rotating.

As shown in FIG. 6A, the roller body 11A of the developing roller 11 is formed of a conductive rubber. Thus, the roller body 11A is eccentric to an extent of an error due to processing accuracy. Therefore, when the developing roller 11 rotates in a state (see FIG. 1) where the toner cartridge 3 is mounted on the main unit 2, and the toner supply pipe 61 is located at the inside position, as shown in FIG. 6B, the developing unit 5 moves relative to the photosensitive drum 7, due to the eccentricity of the roller body 11A.

At this time, that is, when the developing unit 5 moves relative to the photosensitive drum 7 in a state where the toner cartridge 3 is mounted on the main unit 2, and the toner supply pipe 61 is located at the inside position, the developing frame 41 (see FIG. 1) moves relative to the toner supply pipe 61 (see FIG. 1). At this time, the toner supply pipe 61 remains located at the inside position. That is, the toner supply opening 65 of the toner supply pipe 61 remains located at the downstream side of the seal member 42 in the first direction, as described later. In other words, the toner supply opening 65 remains located inside the developing frame 41. Thereby, the toner discharged from the toner supply opening 65 is prevented from staining an outer surface of the developing frame 41, when the developing unit 5 moves relative to the photosensitive drum 7 in a state where the toner cartridge 3 is mounted on the main unit 2, and the toner supply pipe 61 is located at the inside position.

At this time, the first boss 47 is guided by the first elongated hole 32, the second boss 48 is guided by the second elongated hole 33, the third boss 49 (see FIG. 4) is guided by the third elongated hole, and the fourth boss 50 (see FIG. 4) is guided by the fourth elongated hole. Since the first elongated hole 32, the second elongated hole 33, the third elongated hole and the fourth elongated hole extend in the mounting direction, the direction in which the developing unit 5 moves relative to the photosensitive drum 7 is parallel to the direction in which the toner supply pipe 61 moves between the inside position and the outside position.

Figure 5:
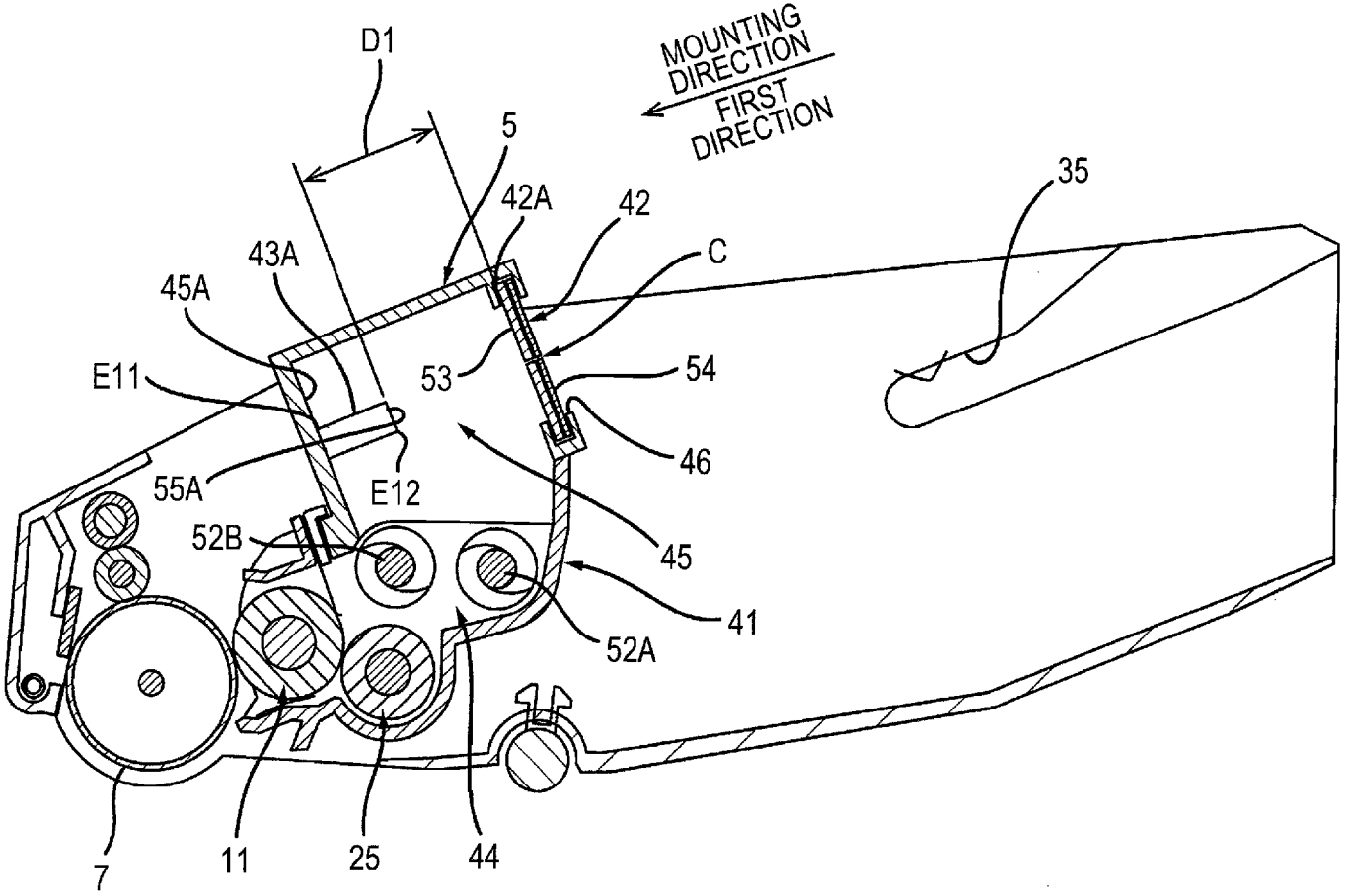
FIG. 5 is a cross-sectional view taken along line B-B of FIG. 4.

As shown in FIG. 4 and FIG. 5, the developing frame 41 has a developing chamber 44, an insertion space 45, an inner surface 45A, and an insertion opening 46.

The developing chamber 44 is an internal space of the developing frame 41, and is a space where the toner to be supplied to the photosensitive drum 7 by the developing roller 11 is stored. The developing chamber 44 extends in the axial direction. A part of the developing roller 11 and the supply roller 25 are accommodated in the developing chamber 44.

The insertion space 45 is an internal space of the developing frame 41, and is a space in which the toner supply pipe 61 (see FIG. 1) is inserted. The insertion space 45 is located closer to the one end E1 of the developing frame 41 than to the other end E2 of the developing frame 41. The insertion space 45 communicates with the developing chamber 44. The insertion space 45 is located above the developing chamber 44 in a state where the process unit 1 is mounted on an image forming apparatus 100 (see FIG. 10) described later.

The inner surface 45A is an inner surface of the developing frame 41, and is an inner surface located at a downstream end of the insertion space 45 in the first direction. The inner surface 45A is located with a space with respect to the seal member 42 in the first direction. The inner surface 45A faces a downstream end E32 (see FIG. 1) of the toner supply pipe 61 with a space S therebetween in a state where the toner cartridge 3 is mounted on the main unit 2. Thereby, as shown in FIG. 6B, due to the movement of the developing unit 5 relative to the photosensitive drum 7, even when the developing frame 41 moves relative to the toner supply pipe 61, the toner supply pipe 61 is prevented from interfering with (abutting) the inner surface 45A and disturbing the movement of the developing frame 41.

The insertion opening 46 is an opening into which the toner supply pipe 61 is inserted when the toner cartridge 3 is mounted onto the main unit 2. The insertion opening 46 is located at an upstream side of the insertion space 45 in the first direction.

2.2.2 Seal Member

As shown in FIG. 1, the seal member 42 seals between the developing frame 41 and the toner supply pipe 61 in a state where the toner supply pipe 61 is located at the inside position. As shown in FIG. 5, the seal member 42 is located in the insertion opening 46. The seal member 42 extends in a direction intersecting the first direction. Preferably, the seal member 42 extends in a direction perpendicular to the first direction. The seal member 42 has elasticity. Specifically, the seal member 42 includes a seal layer 53 and a support layer 54. The seal member 42 has a cutting C.

The seal layer 53 is provided for securing the sealing performance of the seal member 42. The seal layer 53 is formed of, for example, a sponge, in order to reliably capture the toner.

The support layer 54 is provided for securing the elasticity of the seal member 42. The support layer 54 is formed of, for example, a rubber or resin. The support layer 54 is located at the opposite side of the insertion space 45 with respect to the seal layer 53 in the first direction.

The cutting C is provided for forming an opening in a center portion of the seal member 42 when the toner supply pipe 61 moves from the outside position to the inside position. The cutting C is located at the center portion of the seal member 42. Due to expansion of the cutting C, the opening is formed in the center portion of the seal member 42. Thereby, the insertion opening 46 is opened. The shape and the number of the cutting C are not limited.

As shown in FIG. 3, the seal member 42 is deformed by being pressed by the toner supply pipe 61 when the toner supply pipe 61 moves from the outside position to the inside position. Thereby, the cutting C expands, and the opening is formed in the center portion of the seal member 42. The toner supply pipe 61 passes the opening formed due to the expansion of the cutting C, and moves from the outside position to the inside position. As shown in FIG. 1, the seal member 42 contacts a circumferential surface of the toner supply pipe 61 in a state where the toner supply pipe 61 is located at the inside position. Thereby, the seal member 42 seals between the developing frame 41 and the toner supply pipe 61. As shown in FIG. 5, the seal member 42 is restored by the elasticity of the seal member 42 when the toner supply pipe 61 moves from the inside position to the outside position. Thereby, due to the contraction of the cutting C, the formed opening is closed. Thereby, the seal member 42 closes the insertion opening 46 when the toner supply pipe 61 moves from the inside position to the outside position.

2.2.3 Protrusion

As shown in FIG. 3, the protrusion 43A is configured to contact a rib 68A (see FIG. 8B) of the first shutter 62 described later when the toner supply pipe 61 moves from the outside position to the inside position. As shown in FIG. 4, the protrusion 43A is located inside the developing frame 41 and protrudes from the developing frame 41. Specifically, the protrusion 43A is located in the insertion space 45. The protrusion 43A protrudes from the inner surface of the developing frame 41 in the axial direction. The protrusion 43A extends in the first direction. The protrusion 43A has a downstream end E11 and an upstream end E12 in the first direction. The protrusion 43A has a first contact surface 55A at the upstream end E12. That is, the developing unit 5 has the first contact surface 55A. The first contact surface 55A is located at the downstream side of the seal member 42 in the first direction. A distance D1 (see FIG. 5) between the first contact surface 55A and a downstream end 42A of the seal member 42 in the first direction is larger than a distance D2 (see FIG. 9A) between a second contact surface 69A and an upstream end 65A of the toner supply opening 65 in the first direction in a state where the first shutter 62 is located at the closed position. Thereby, as shown in FIG. 3, when the toner supply pipe 61 moves from the outside position to the inside position, and the rib 68A of the first shutter 62 contacts the protrusion 43A, the toner supply opening 65 is located at a farther downstream side than the seal member 42 in the first direction, that is, in the insertion space 45. Thereby, the first shutter 62 moves from the closed position (see FIG. 3) to the open position (see FIG. 1) relative to the toner supply pipe 61 in a state where the toner supply opening 65 is located in the insertion space 45.

As shown in FIG. 4, the protrusion 43B is configured to contact a rib 68B (see FIG. 8B) of the first shutter 62 described later when the toner supply pipe 61 moves from the outside position to the inside position. The protrusion 43B is located inside the developing frame 41. Specifically, the protrusion 43B is located in the insertion space 45. The protrusion 43B is located with a space with respect to the protrusion 43A in the axial direction. The protrusion 43B protrudes from the inner surface of the developing frame 41 in the axial direction. The protrusion 43B extends in the first direction. The protrusion 43B has a downstream end E13 and an upstream end E14 in the first direction. The protrusion 43B has a first contact surface 55B at the upstream end E14. The first contact surface 55B is located at the downstream side of the seal member 42 in the first direction. The distance between the first contact surface 55B and the downstream end 42A of the seal member 42 in the first direction is the same as the distance D1 (see FIG. 5) between the first contact surface 55A and the downstream end 42A of the seal member 42 in the first direction, and is larger than a distance D3 (see FIG. 9B) between a second contact surface 69B and the upstream end 65A of the toner supply opening 65 in the first direction in a state where the first shutter 62 is located at the closed position.

The protrusion 43A contacts the rib 68A, and the protrusion 43B contacts the rib 68B, and thereby, the first shutter 62 moves relative to the toner supply pipe 61 in a state where the balance in the axial direction is maintained. Thereby, the first shutter 62 smoothly moves relative to the toner supply pipe 61.

2.2.4 Auger Screw

As shown in FIG. 5, the auger screw 52A is configured to convey the toner in the developing chamber 44 in the axial direction. Specifically, the auger screw 52A is configured to convey the toner in the developing chamber 44 in a direction away from the insertion opening 46 in the axial direction. The auger screw 52A is located in the developing chamber 44. The auger screw 52A extends in the axial direction.

The auger screw 52B is configured to convey the toner in the developing chamber 44 in an opposite direction, in the axial direction, from the direction in which the auger screw 52A conveys the toner in the developing chamber 44. Specifically, the auger screw 52B is configured to convey the toner in the developing chamber 44 toward the insertion opening 46 in the axial direction. The auger screw 52B is located in the developing chamber 44. The auger screw 52B is located between the developing roller 11 and the auger screw 52A in the mounting direction. The auger screw 52B extends in the axial direction.

2.3 Toner Cartridge

As shown in FIG. 7, the toner cartridge 3 extends in the axial direction. The toner cartridge 3 has a one end E21, and an other end E22 located away from the one end E21 in the axial direction. The protruding portion 26 of the toner recovery box 18 described above is located at the one end E21. The protruding portion 26 protrudes from the one end E21. The toner cartridge 3 is located between the drum side plate 31A (see FIG. 4) and the drum side plate 31B (see FIG. 4) in a state where the toner cartridge 3 is mounted on the main unit 2. The toner cartridge 3 is supported by the drum side plate 31A and the drum side plate 31B in a state where the toner cartridge 3 is mounted on the main unit 2. The one end E21 is located closer to the drum side plate 31A than to the drum side plate 31B in the axial direction in a state where the toner cartridge 3 is mounted on the main unit 2. The one end E21 faces the drum side plate 31A in a state where the toner cartridge 3 is mounted on the main unit 2. The other end E22 is located closer to the drum side plate 31B than to the drum side plate 31A in the axial direction in a state where the toner cartridge 3 is mounted on the main unit 2. The other end E22 faces the drum side plate 31B in a state where the toner cartridge 3 is mounted on the main unit 2. The toner cartridge 3 includes the toner supply pipe 61, the first shutter 62, a cover 63, a spring 64 (see FIG. 8A), the boss 72A, and the boss 72B.

2.3.1 Toner Supply Pipe

As shown in FIG. 1, the toner supply pipe 61 is configured to supply the toner to the developing chamber 44 of the developing unit 5 in a state where the toner cartridge 3 is mounted on the main unit 2, where the toner supply pipe 61 is located at the inside position, and where the first shutter 62 is located at the open position. As shown in FIG. 7, the toner supply pipe 61 is located at the downstream side of the toner accommodation box 17 in the first direction. The toner supply pipe 61 has a first portion 61A and a second portion 61B.

The first portion 61A communicates with the toner accommodation box 17. Specifically, the first portion 61A communicates with the toner accommodation box 17 through an opening (not shown) extending in the axial direction. The first portion 61A extends in the axial direction.

The second portion 61B continues to the first portion 61A. The second portion 61B communicates with the first portion 61A. The second portion 61B is located closer to the one end E21 of the toner cartridge 3 than to the other end E22 of the toner cartridge 3 in the axial direction. The second portion 61B extends in the first direction. The second portion 61B has an upstream end E31 and a downstream end E32 in the first direction. That is, the toner supply pipe 61 has the downstream end E32 in the first direction.

Figure 8A:
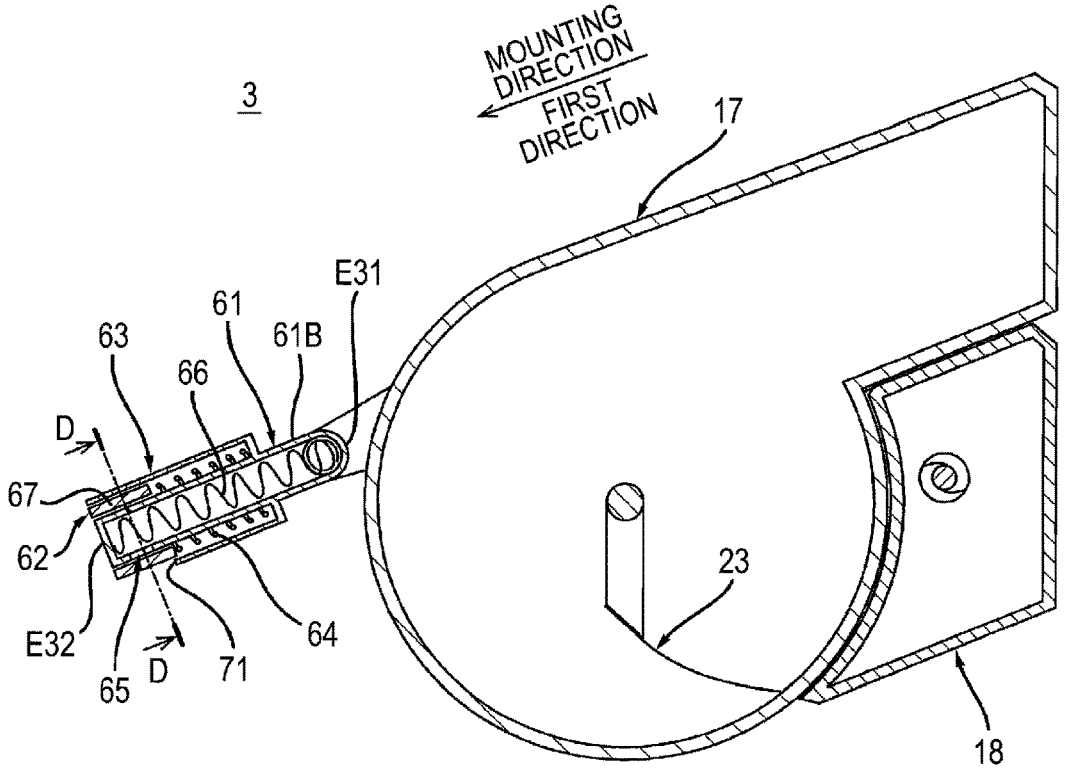
FIG. 8A is a cross-sectional view taken along line C-C of FIG. 7.
Figure 8B:
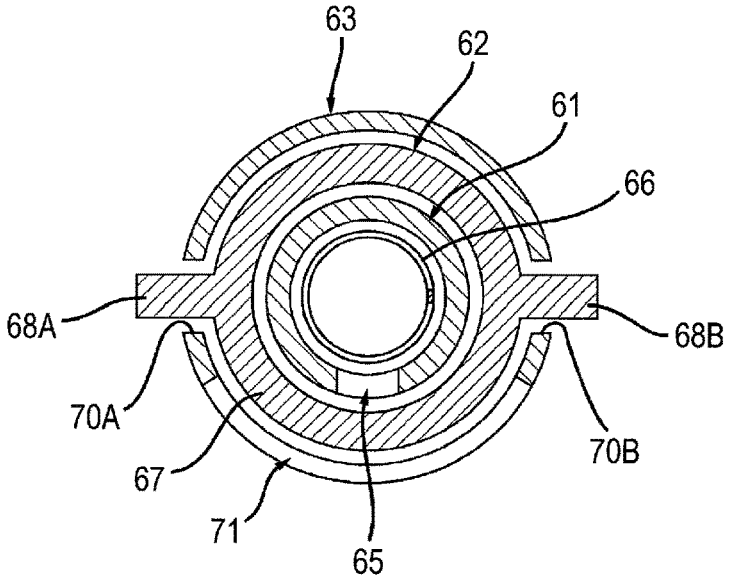
FIG. 8B is a cross-sectional view taken along line D-D of FIG. 8A.

As shown in FIG. 8A and FIG. 8B, the toner supply pipe 61 has the toner supply opening 65. The toner supply pipe 61 includes a screw 66.

The toner supply opening 65 discharges the toner conveyed by the screw 66 in a state where the toner cartridge 3 is mounted on the main unit 2, where the toner supply pipe 61 is located at the inside position, and where the first shutter 62 is located at the open position (see FIG. 1). The toner supply opening 65 is provided in the second portion 61B. The toner supply opening 65 is located closer to the downstream end E32 of the second portion 61B than to the upstream end E31 of the second portion 61B in the first direction. The toner supply opening 65 is located at the downstream side of the seal member 42 in the first direction in a state where the toner supply pipe 61 is located at the inside position (see FIG. 1 and FIG. 3). Thereby, when the first shutter 62 moves from the closed position to the open position, the toner supply opening 65 is reliably located in the developing frame 41.

As shown in FIG. 7, the screw 66 is configured to convey the toner in the toner supply pipe 61 toward the toner supply opening 65 (see FIG. 8A). Specifically, the screw 66 is configured to convey the toner supplied from the toner accommodation box 17 to the first portion 61A, toward the toner supply opening 65. The screw 66 is located inside the toner supply pipe 61. Specifically, the screw 66 is located inside the first portion 61A and the second portion 61B. The screw 66 extends in a direction in which the toner supply pipe 61 extends. The screw 66 has a spiral shape. The screw 66 does not have a shaft. Thereby, the screw 66 is located inside the toner supply pipe 61 in a state of being bent along the shape of the toner supply pipe 61.

2.3.2 First Shutter

As shown in FIG. 8A, the first shutter 62 is located in the outer surface of the second portion 61B. The first shutter 62 is movable relative to the second portion 61B between the open position and the closed position in a direction in which the second portion 61B extends. Thereby, the first shutter 62 moves relative to the toner supply pipe 61 in a direction parallel to the first direction, when the toner cartridge 3 is mounted onto the main unit 2. As shown in FIG. 8B, the first shutter 62 includes a base 67, the rib 68A, and a rib 68B.

The base 67 closes the toner supply opening 65 when the first shutter 62 is located at the closed position. The base 67 is located between the toner supply pipe 61 and the cover 63. The base 67 has a cylindrical shape. The base 67 is movable along the outer surface of the toner supply pipe 61. Specifically, the base 67 is movable along the outer surface of the second portion 61B of the toner supply pipe 61.

Figure 9A:
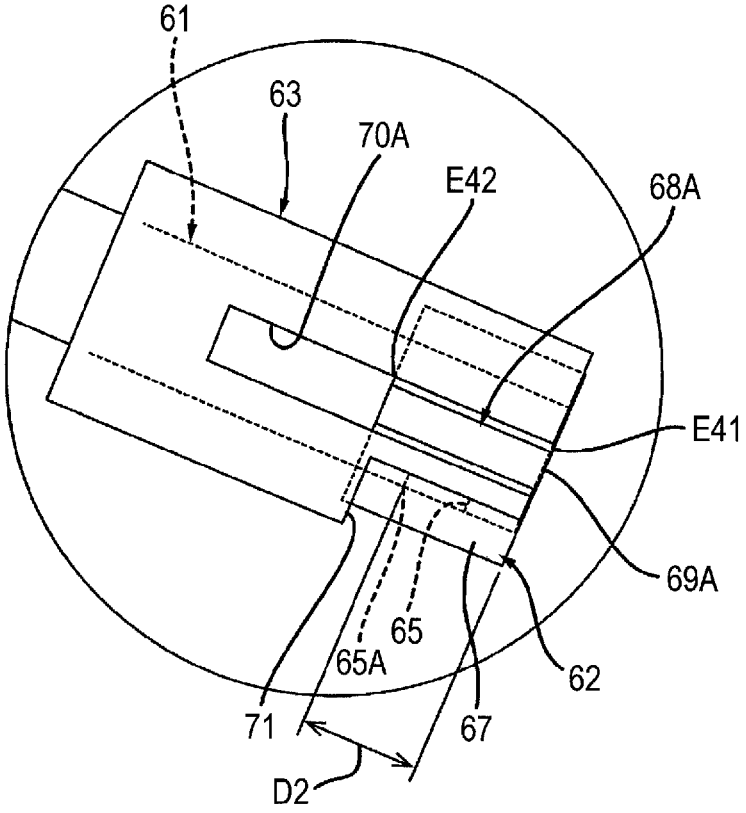
FIG. 9A is a side view of a toner supply pipe viewed from an axial direction.

As shown in FIG. 8B and FIG. 9A, the rib 68A is configured to contact the protrusion 43A (see FIG. 4) of the developing unit 5 when the toner supply pipe 61 moves from the outside position to the inside position. The rib 68A protrudes from the outer surface of the base 67. Specifically, the rib 68A protrudes from the outer surface of the base 67 in the axial direction. The rib 68A is received in a guide groove 70A of the cover 63 described later. The rib 68A protrudes from the cover 63 through the guide groove 70A in the axial direction. The rib 68A extends in the first direction. The rib 68A has a downstream end E41 and an upstream end E42 in the first direction. The rib 68A has the second contact surface 69A at the downstream end E41. That is, the first shutter 62 has the second contact surface 69A. When the toner supply pipe 61 moves from the outside position to the inside position, the second contact surface 69A contacts the first contact surface 55A (see FIG. 4) of the protrusion 43A in order to move the first shutter 62 from the closed position to the open position. The second contact surface 69A is located at the downstream side of the toner supply opening 65 in the first direction in a state where the first shutter 62 is located at the closed position.

Figure 9B:
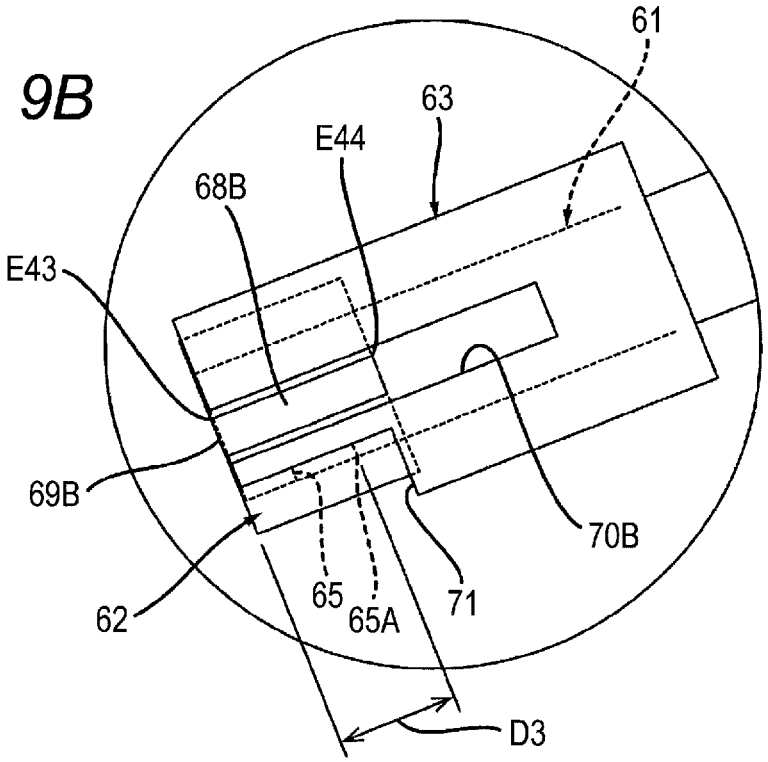
FIG. 9B is a side view of the toner supply pipe viewed from an opposite direction from the direction of FIG. 9B in the axial direction.

As shown in FIG. 8B and FIG. 9B, the rib 68B is configured to contact the protrusion 43B (see FIG. 4) of the developing unit 5 when the toner supply pipe 61 moves from the outside position to the inside position. The rib 68B is located at the opposite side of the rib 68A with respect to the base 67 in the axial direction. Thereby, when the protrusion 43A contacts the rib 68A and the protrusion 43B contacts the rib 68B, the balance of the first shutter 62 in the axial direction is secured. As a result, the first shutter 62 smoothly moves relative to the toner supply pipe 61. The rib 68B protrudes from the outer surface of the base 67 in the axial direction. The rib 68B is received in a guide groove 70B of the cover 63 described later. The rib 68B protrudes from the cover 63 through the guide groove 70B in the axial direction. The rib 68B extends in the first direction. The rib 68B has a downstream end E43 and an upstream end E44 in the first direction. The rib 68B has the second contact surface 69B at the downstream end E43. That is, the first shutter 62 has the second contact surface 69B. When the toner supply pipe 61 moves from the outside position to the inside position, the second contact surface 69B contacts the first contact surface 55B (see FIG. 4) of the protrusion 43B in order to move the first shutter 62 from the closed position to the open position. The second contact surface 69B is located at the downstream side of the toner supply opening 65 in the first direction in a state where the first shutter 62 is located at the closed position.

When the toner cartridge 3 is mounted on the main unit 2, the rib 68A abuts the protrusion 43A in the first direction, and the rib 68B abuts the protrusion 43B in the first direction, and thereby, the first shutter 62 moves from the closed position to the open position relative to the toner supply pipe 61. The first shutter 62 moves from the open position to the closed position relative to the toner supply pipe 61 by being pressed by the spring 64 (see FIG. 8A) when the toner cartridge 3 is detached from the main unit 2.

2.3.3 Cover

As shown in FIG. 8A and FIG. 8B, the cover 63 covers the outer surface of the toner supply pipe 61 and the spring 64. The cover 63 has a cylindrical shape. The cover 63 has the guide groove 70A, a guide groove 70B, and a cutout 71.

The guide groove 70A is configured to guide the rib 68A when the first shutter 62 moves. The guide groove 70A extends in the first direction. The rib 68A is inserted in the guide groove 70A.

The guide groove 70B is configured to guide the rib 68B when the first shutter 62 moves. The guide groove 70B is located at the opposite side of the guide groove 70A with respect to the toner supply pipe 61 in the axial direction. The guide groove 70B extends in the first direction. The rib 68B is inserted in the guide groove 70B.

The cutout 71 is configured to expose the toner supply opening 65 when the first shutter 62 is located at the open position. The cutout 71 is located at the opposite side of the screw 66 with respect to the toner supply opening 65 in a radial direction of the second portion 61B of the toner supply pipe 61. The cutout 71 communicates with the toner supply opening 65 when the first shutter 62 is located at the open position. A part of the base 67 of the first shutter 62 is located between the cutout 71 and the toner supply opening 65 when the first shutter 62 is located at the closed position.

2.3.4 Spring

As shown in FIG. 1, the spring 64 presses the first shutter 62 located at the open position toward the closed position. As shown in FIG. 8A, the spring 64 is located between the cover 63 and the toner supply pipe 61 in the radial direction of the second portion 61B of the toner supply pipe 61. The spring 64 contacts the first shutter 62. The spring 64 is covered by the cover 63. Specifically, as shown in FIG. 1 and FIG. 3, in a state where the first shutter 62 is located at the open position, and in a state where the first shutter 62 is located at the closed position, the entire spring 64 is covered by the cover 63. Thereby, the toner in the developing unit 5 is prevented from adhering to the spring 64 in a state where the toner supply pipe 61 is located at the inside position.

The positioning protrusion 36 (see FIG. 1) in the guide 35 described above, and the positioning protrusion (not shown) in the guide 34 position the toner cartridge 3 relative to the main unit 2 against the elastic force of the spring 64.

2.3.5 Boss

As shown in FIG. 7, the boss 72A is located at the one end E21 of the toner cartridge 3. The boss 72A is fitted in the guide 34 (see FIG. 4) of the drum unit 4. The boss 72A extends in the axial direction. The boss 72A has a cylindrical shape.

The boss 72B is located at the other end E22 of the toner cartridge 3. The boss 72B is fitted in the guide 35 (see FIG. 4) of the drum unit 4. The boss 72B extends in the axial direction. The boss 72B has a cylindrical shape.

3. Usage Mode of Process Unit

Figure 10:
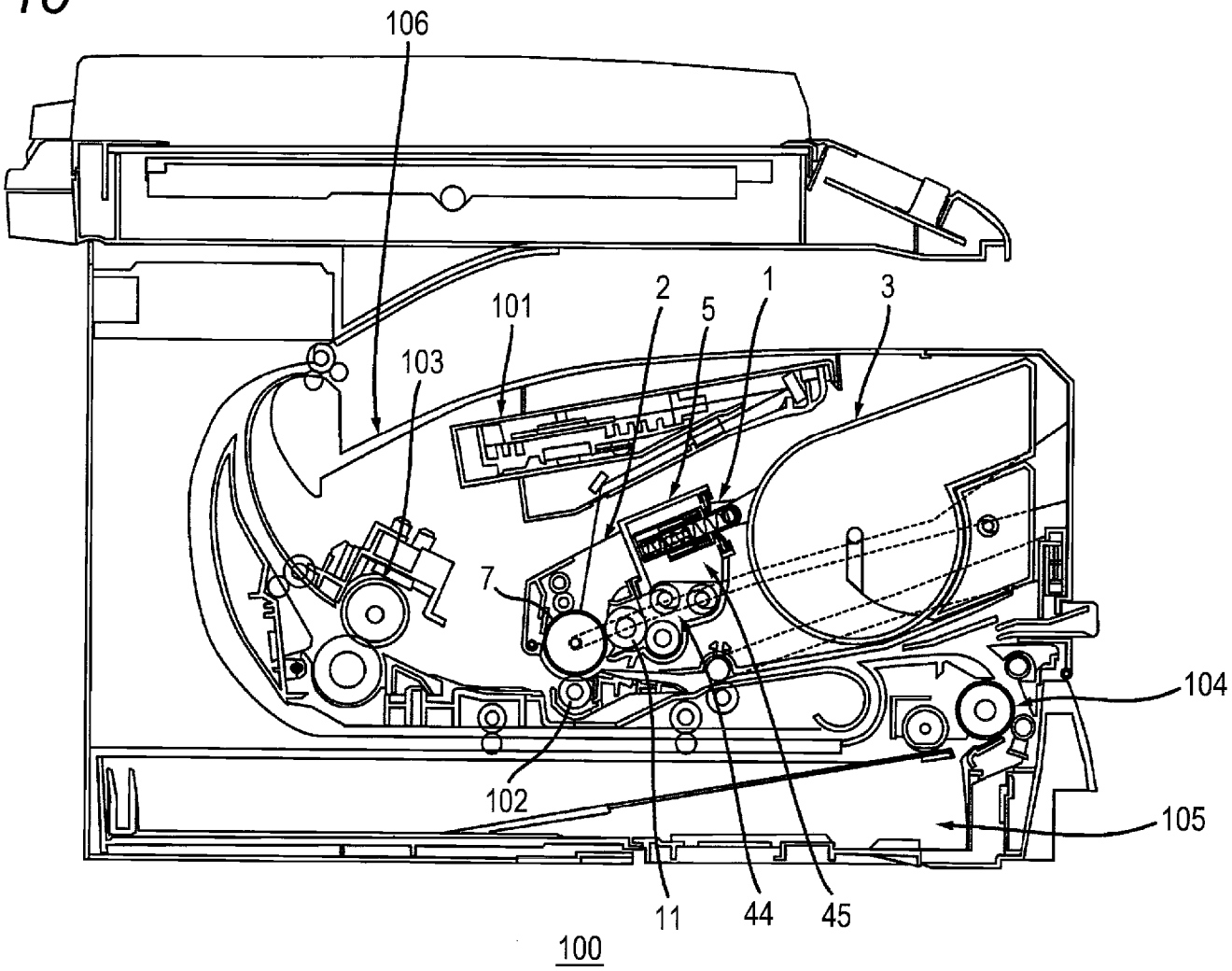
FIG. 10 is an explanatory diagram for explaining a use mode of a process unit shown in FIG. 1.

As shown in FIG. 10, the process unit 1 described above is mounted on the image forming apparatus 100. The process unit 1 is detachably mounted on the image forming apparatus 100. The toner cartridge 3 is detachably mounted on the main unit 2 in a state where the main unit 2 is mounted on the image forming apparatus 100.

The image forming apparatus 100 includes a laser scan unit 101, a transfer roller 102, a fixing device 103, a paper feeding section 104, a paper feeding tray 105, and a paper discharge tray 106. The laser scan unit 101 is configured to expose the surface of the photosensitive drum 7. The transfer roller 102 is configured to transfer a toner image formed in the circumferential surface of the photosensitive drum 7 onto a sheet. The transfer roller 102 contacts the circumferential surface of the photosensitive drum 7. The fixing device 103 is configured to heat and apply pressure to the sheet having the transferred toner image to fix the toner image onto the sheet. The paper feeding section 104 is configured to feed the sheet in the sheet feeding tray 105 to between the photosensitive drum 7 and the transfer roller 102. The paper feeding tray 105 is configured to accommodate sheets. The sheet that has passed the fixing device 103 is discharged onto the paper discharge tray 106.

4. Operation and Effect

As shown in FIG. 1 and FIG. 3, according to the process unit 1, when the toner cartridge 3 is mounted onto the main unit 2, the first shutter 62 moves relative to the toner supply pipe 61 from the closed position (see FIG. 3) to the open position (FIG. 1) in a state where the toner supply opening 65 is located inside the developing frame 41.

Thus, the toner discharged from the toner supply opening 65 is prevented from staining the outer surface of the developing frame 41.

As a result, the developing unit 5 is prevented from being stained when the toner cartridge 3 is mounted onto the main unit 2.

5. Second Embodiment

A process unit of a second embodiment will be described while referring to FIG. 11 to FIG. 15 wherein like parts and components are designated by the same reference numerals to avoid duplicating description.

Figure 11:
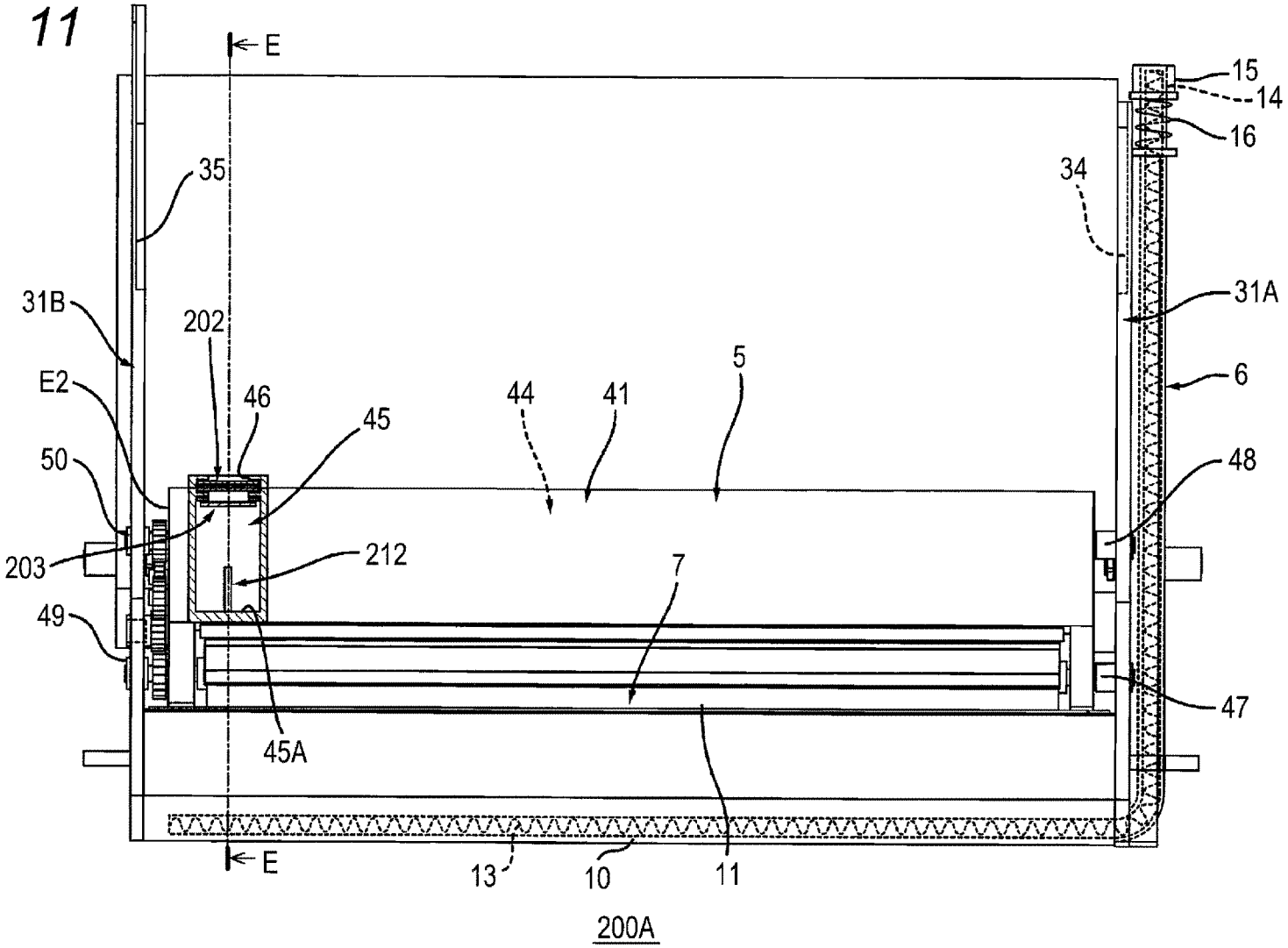
FIG. 11 is a plan view of a main unit of a process unit of a second embodiment, wherein in order to illustrate an inside of an insertion space, a part of a developing frame is shown as a cross section.
Figure 13:
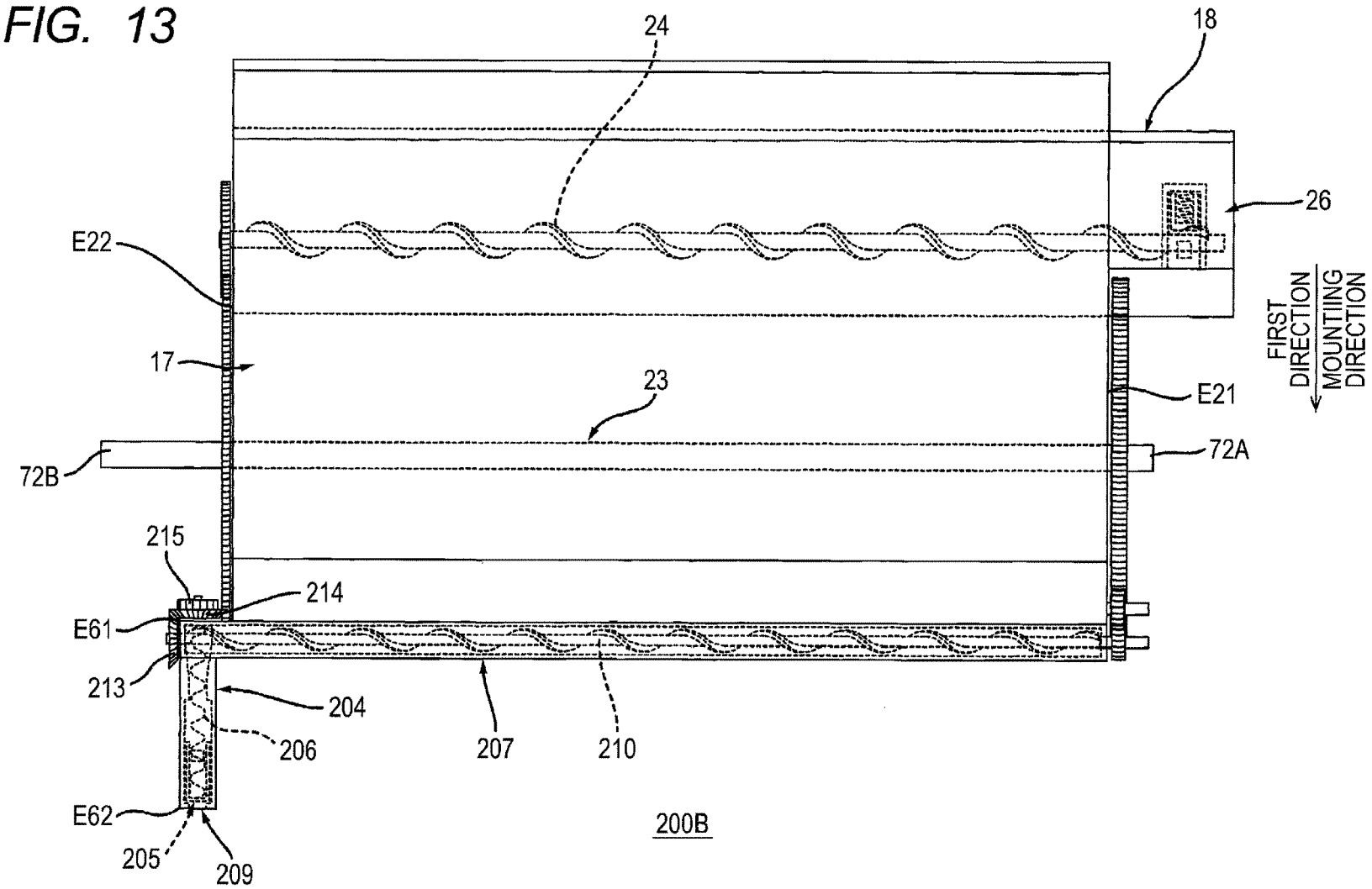
FIG. 13 is a plan view of a toner cartridge of the process unit of the second embodiment.

As shown in FIG. 11 and FIG. 13, the process unit of the second embodiment includes a main unit 200A and a toner cartridge 200B.

5.1 Developing Unit

Figure 12:
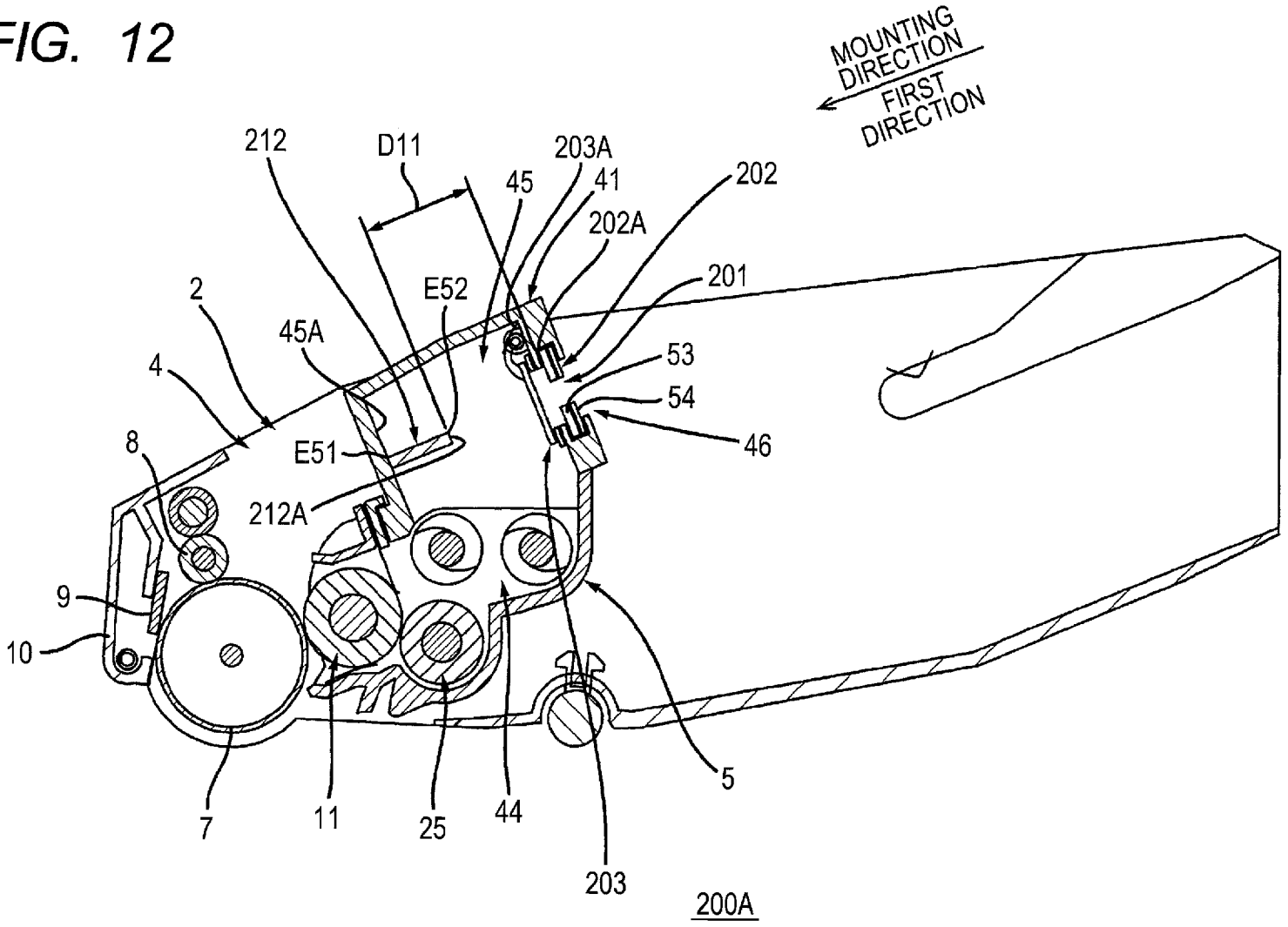
FIG. 12 is a cross-sectional view taken along line E-E of FIG. 11.

As shown in FIG. 11, the insertion space 45 and the insertion opening 46 of the main unit 200A are located closer to the drum side plate 31B than to the drum side plate 31A in the axial direction. As shown in FIG. 12, the developing unit 5 includes a seal member 202, a second shutter 203, and a protrusion 212.

5.1.1 Seal Member

In a state where a toner supply pipe 204 (see FIG. 14 and FIG. 15) is located at the inside position, the seal member 202 seals between the developing frame 41 and the toner supply pipe 204. The seal member 202 is located in the insertion opening 46. The seal member 202 extends in a direction intersecting the first direction. Preferably, the seal member 202 extends in a direction perpendicular to the first direction. The seal member 202 has elasticity. Specifically, the seal member 202 includes the seal layer 53 described above, and the support layer 54 described above. The seal member 202 has an opening 201.

When the toner supply pipe 204 is located at the inside position, the toner supply pipe 204 is inserted in the opening 201. The opening 201 is located at the center portion of the seal member 202. The diameter of the opening 201 is smaller than the diameter of the toner supply pipe 204.

Figure 14:
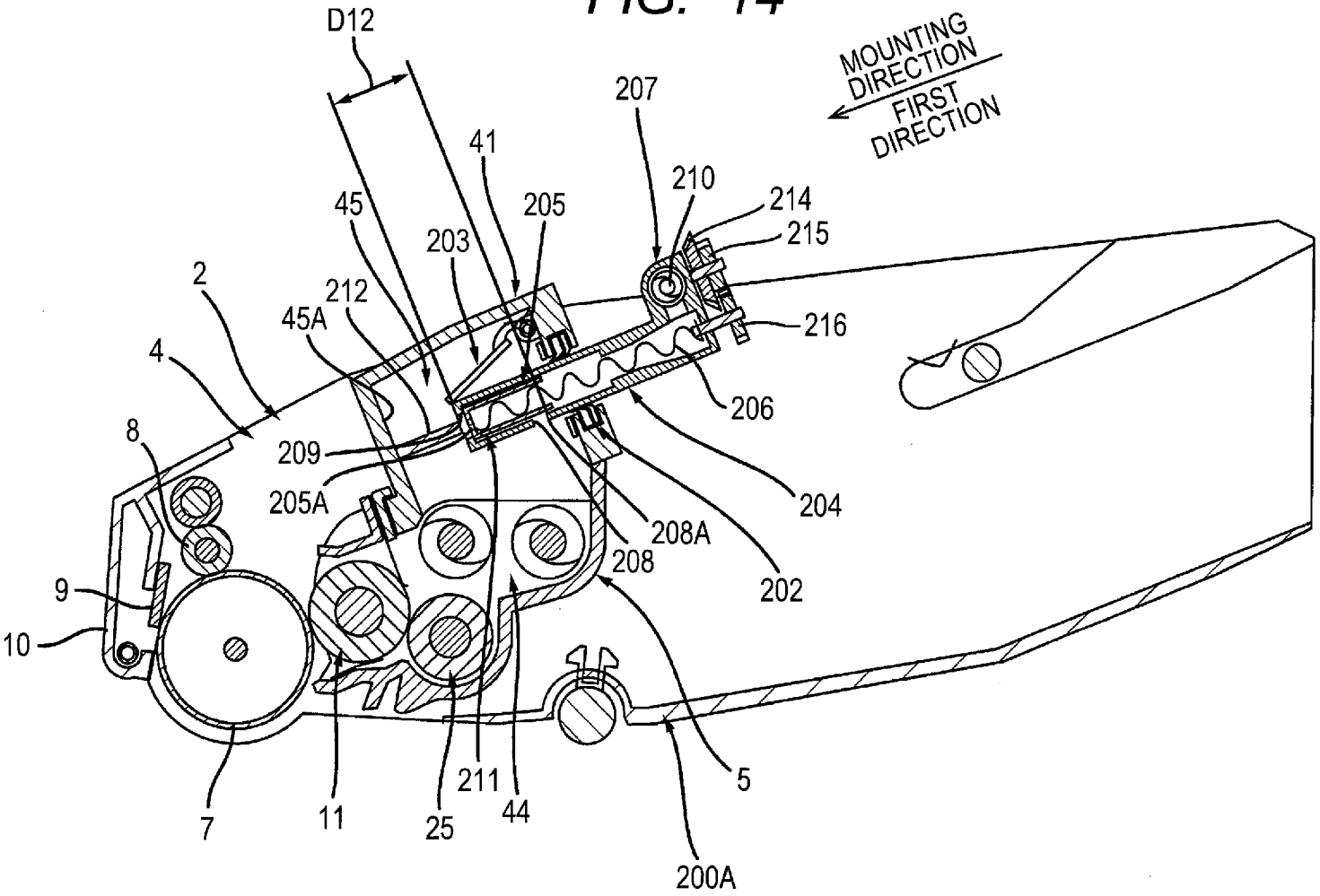
FIG. 14 is an explanatory diagram for explaining opening and closing operation of a first shutter of the toner cartridge shown in FIG. 13, and shows a state where a toner supply pipe is located at an inside position, and a first shutter is located at a closed position.
Figure 15:
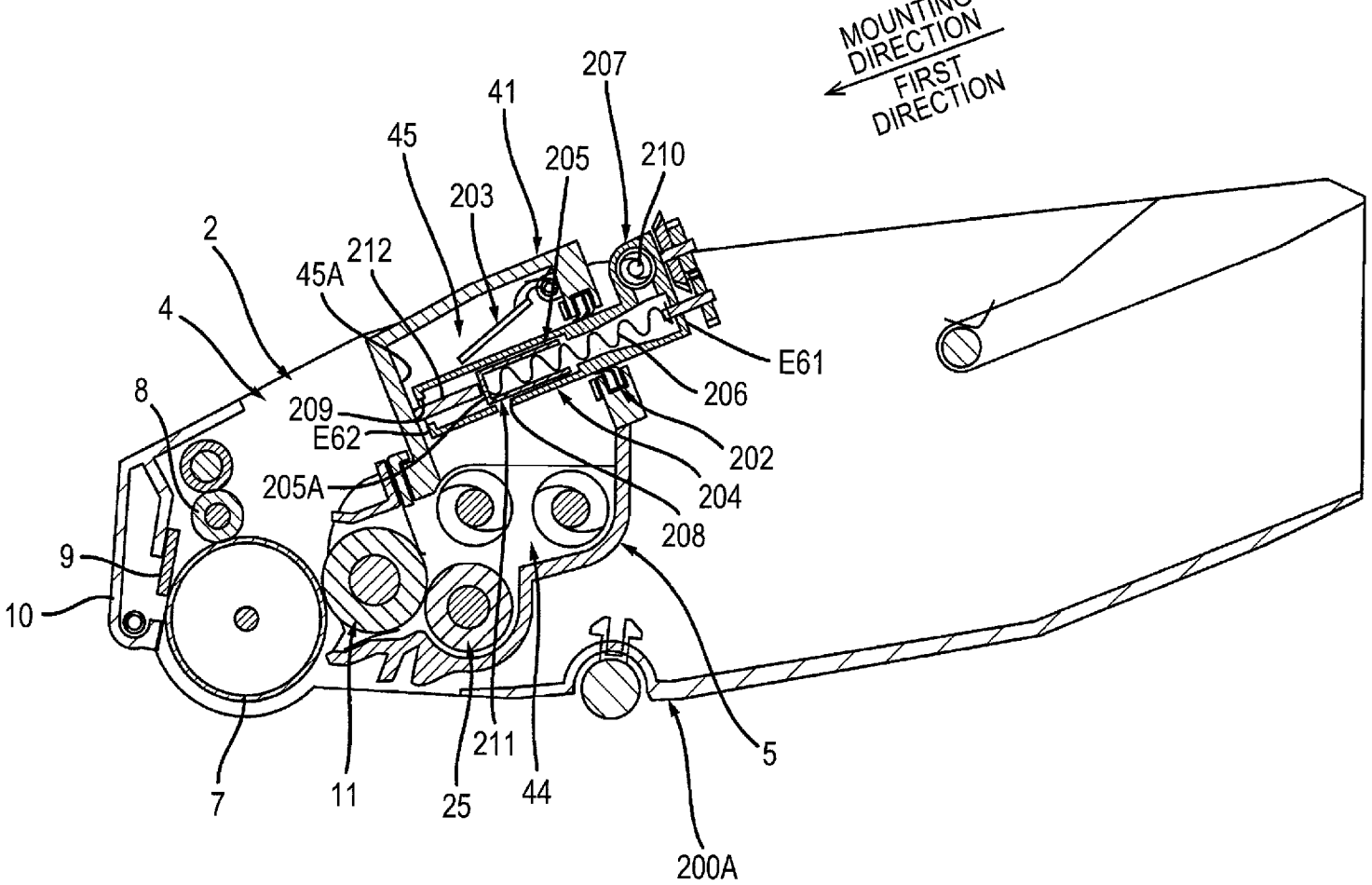
FIG. 15 is an explanatory diagram for explaining the opening and closing operation of the first shutter, together with FIG. 14, and shows a state where the toner supply pipe is located at the inside position, and the first shutter is located at the open position.

As shown in FIG. 14 and FIG. 15, in a state where the toner supply pipe 204 is located at the inside position, the seal member 202 deforms so that the opening 201 (see FIG. 12) expands by being pressed by the toner supply pipe 204. The seal member 202 contacts the circumferential surface of the toner supply pipe 204 in a state where the toner supply pipe 204 is located at the inside position. Thereby, the seal member 202 seals between the developing frame 41 and the toner supply pipe 204.

5.1.2 Second Shutter

As shown in FIG. 12, the second shutter 203 is movable relative to the developing frame 41 between an open position (see FIG. 15) at which the insertion opening 46 is opened and a closed position (see FIG. 12) at which the insertion opening 46 is closed. The second shutter 203 is located at the downstream side of the seal member 202 in the first direction. The second shutter 203 is located in the insertion space 45. The second shutter 203 is pressed toward the closed position by a coil spring 203A.

5.1.3 Protrusion

As shown in FIG. 14, the protrusion 212 is configured to contact a first shutter 205 described later, when the toner supply pipe 204 moves from the outside position to the inside position. As shown in FIG. 12, the protrusion 212 is located inside the developing frame 41, and protrudes from the developing frame 41. Specifically, the protrusion 212 is located in the insertion space 45. The protrusion 212 protrudes from the inner surface 45A of the developing frame 41. The protrusion 212 extends in the first direction. The protrusion 212 has a downstream end E51 and an upstream end E52 in the first direction. The protrusion 212 has a first contact surface 212A at the upstream end E52. That is, the developing unit 5 has the first contact surface 212A. The first contact surface 212A is located at the downstream side of the seal member 202 in the first direction. A distance D11 between the first contact surface 212A and a downstream end 202A of the seal member 202 in the first direction is larger than a distance D12 (see FIG. 14) between a second contact surface 205A and an upstream end 208A of a toner supply opening 208 in the first direction in a state where the first shutter 205 is located at the closed position. Thereby, as shown in FIG. 14, when the toner supply pipe 204 moves from the outside position to the inside position, and the first shutter 205 contacts the protrusion 212, the toner supply opening 208 is located at a farther downstream side than the seal member 202 in the first direction, that is, in the insertion space 45. Thereby, the first shutter 205 moves from the closed position (see FIG. 14) to the open position (see FIG. 15) relative to the toner supply pipe 204 in a state where the toner supply opening 208 is located in the insertion space 45.

5.2 Toner Cartridge

As shown in FIG. 13, the toner cartridge 200B includes the toner supply pipe 204, the first shutter 205, a flexible screw 206, a toner conveyance pipe 207, an auger screw 210, a first bevel gear 213, a second bevel gear 214, an idle gear 215, and a screw gear 216 (see FIG. 14).

5.2.1 Toner Supply Pipe

The toner supply pipe 204 is configured to supply the toner to the developing chamber 44 of the developing unit 5 in a state (see FIG. 15) where the toner cartridge 200B is mounted on the main unit 200A, where the toner supply pipe 204 is located at the inside position, and where the first shutter 205 is located at the open position. The toner supply pipe 204 is located at the downstream side of the toner accommodation box 17 in the first direction. The toner supply pipe 204 is located closer to the other end E22 of the toner cartridge 200B than to the one end E21 of the toner cartridge 200B in the axial direction. The toner supply pipe 204 extends in the first direction. The toner supply pipe 204 has an upstream end E61 and a downstream end E62 in the first direction. The toner supply pipe 204 has the toner supply opening 208 and an opening 209.

The toner supply opening 208 discharges the toner discharged from an opening 211 of the first shutter 205 in a state where the toner cartridge 200B is mounted on the main unit 200A, where the toner supply pipe 204 is located at the inside position, and where the first shutter 205 is located at the open position. The toner supply opening 208 is located closer to the downstream end E62 than to the upstream end E61 in the first direction. The toner supply opening 208 is located at the downstream side of the seal member 202 in the first direction in a state where the toner supply pipe 204 is located at the inside position (see FIG. 14 and FIG. 15).

The protrusion 212 is inserted in the opening 209 in a state where the toner cartridge 200B is mounted on the main unit 200A, where the toner supply pipe 204 is located at the inside position, and where the first shutter 205 is located at the open position. The opening 209 is located at the downstream end E62 of the toner supply pipe 204.

5.2.2 First Shutter

As shown in FIG. 14 and FIG. 15, the first shutter 205 is movable relative to the toner supply pipe 204 between an open position (see FIG. 15) at which the toner supply opening 208 is opened and a closed position (see FIG. 14) at which the toner supply opening 208 is closed. The first shutter 205 is located inside the toner supply pipe 204. The first shutter 205 has the opening 211 and the second contact surface 205A.

The opening 211 discharges the toner conveyed by the flexible screw 206 in a state where the toner cartridge 200B is mounted on the main unit 200A, where the toner supply pipe 204 is located at the inside position, and where the first shutter 205 is located at the open position. The opening 211 communicates with the toner supply opening 208 in a state where the first shutter 205 is located at the open position (see FIG. 15). Communication of the opening 211 with the toner supply opening 208 is blocked in a state where the first shutter 205 is located at the closed position (see FIG. 14).

When the toner supply pipe 204 moves from the outside position to the inside position, the second contact surface 205A contacts the first contact surface 212A (see FIG. 12) of the protrusion 212 in order to move the first shutter 205 from the closed position to the open position. The second contact surface 205A is located at the downstream side of the toner supply opening 208 in the first direction in a state where the first shutter 205 is located at the closed position. Specifically, the second contact surface 205A is located at the downstream end of the first shutter 205 in the first direction. The second contact surface 205A extends in a direction intersecting the first direction. Preferably, the second contact surface 205A extends in a direction perpendicular to the first direction.

When the toner cartridge 200B is mounted on the main unit 200A, the first shutter 205 abuts the protrusion 212 in the first direction, thereby moving from the closed position to the open position relative to the toner supply pipe 204. The first shutter 205 located at the open position is pressed toward the closed position by the elastic force of the flexible screw 206. Thereby, when the toner cartridge 200B is detached from the main unit 200A, the first shutter 205 moves from the open position to the closed position relative to the toner supply pipe 204.

5.2.3 Flexible Screw

As shown in FIG. 15, the flexible screw 206 is configured to convey the toner inside the toner supply pipe 204 in the first direction. The flexible screw 206 is configured to convey the toner inside the toner supply pipe 204 toward the toner supply opening 208. The flexible screw 206 is arranged inside the toner supply pipe 204. The flexible screw 206 extends in a direction in which the toner supply pipe 204 extends. The flexible screw 206 has a spiral shape. The flexible screw 206 does not have a shaft. Thereby, the flexible screw 206 elastically deforms in the direction in which the toner supply pipe 204 extends. In other words, the flexible screw 206 elastically deforms in the first direction. The flexible screw 206 is configured to press the first shutter 205 located at the open position toward the closed position.

5.2.4 Toner Conveyance Pipe

As shown in FIG. 13, the toner conveyance pipe 207 is located at the downstream side of the toner accommodation box 17 in the first direction. The toner conveyance pipe 207 communicates with the toner accommodation box 17. Specifically, the toner conveyance pipe 207 communicates with the toner accommodation box 17 through an opening (not shown) extending in the axial direction. The toner conveyance pipe 207 extends in the axial direction. The toner conveyance pipe 207 communicates with the upstream end E61 of the toner supply pipe 204.

5.2.5 Auger Screw

As shown in FIG. 13, the auger screw 210 is configured to convey the toner in the toner conveyance pipe 207 toward the toner supply pipe 204. The auger screw 210 is located in the toner supply pipe 207. The auger screw 210 extends in the axial direction.

5.2.6 First Bevel Gear, Second Bevel Gear, Idle Gear, and Screw Gear

The first bevel gear 213, the second bevel gear 214, the idle gear 215, and the screw gear 216 (see FIG. 14) constitute a gear array for transmitting driving from the auger screw 210 to the flexible screw 206. The first bevel gear 213 rotates together with the auger screw 210. The first bevel gear 213 is attached to an end portion of the auger screw 210. The second bevel gear 214 engages the first bevel gear 213. The idle gear 215 rotates together with the second bevel gear 214. The idle gear 215 is a spur gear. As shown in FIG. 14, the screw gear 216 rotates together with the flexible screw 206. The screw gear 216 is attached to an end portion of the flexible screw 206. The screw gear 216 is a spur gear. The screw gear 216 engages the idle gear 215.

5.3 Operation and Effect of Second Embodiment

As shown in FIG. 14 and FIG. 15, in the process unit of the second embodiment, when the toner cartridge 200B is mounted onto the main unit 200A, the first shutter 205 moves from the closed position to the open position in a state where the toner supply opening 208 is located inside the developing frame 41.

Thus, the toner discharged from the toner supply opening 208 is prevented from staining the outer surface of the developing frame 41.

This suppresses staining of the developing unit 5 when the toner cartridge 200B is mounted onto the main unit 200A.

6. Modification

While the disclosure has been described in detail with reference to the above aspects thereof, it would be apparent to those skilled in the art that various changes and modifications may be made therein without departing from the scope of the claims.

For example, the process unit 1 need not be detachably mounted on the image forming apparatus 100. In this case, the main unit 2 may be provided in the image forming apparatus 100, and the toner cartridge 3 may be detachably mounted on the main unit 2 provided in the image forming apparatus 100.

Further, the first contact surface that contacts the first shutter may be located outside the developing frame 41. For example, the outer surface of the developing frame 41 may be the first contact surface. When the toner cartridge 3 is mounted onto the main unit 2, the first shutter may contact the outer surface of the developing frame 41 (the first contact surface) in a state where the toner supply opening 65 is located inside the developing frame 41, thereby moving from the closed position to the open position, with respect to the toner supply pipe 61.

What is claimed is:

1. A process unit for use with a toner cartridge, the toner cartridge being attachable to the process unit, the toner cartridge comprising a toner supply pipe having a toner supply opening, the process unit comprising:

a main unit comprising:

a developing unit having:

a developing roller; and a developing frame supporting the developing roller, the developing frame having an insertion opening; and a seal member configured to seal between the developing frame and the toner supply pipe in a state where the toner supply pipe is inserted into the insertion opening of the developing unit.

2. The process unit according to claim 1, wherein, when the toner cartridge is attached to the process unit, the toner supply pipe moves through the insertion opening from an outside position at which the toner supply opening is located outside the developing frame to an inside position at which the toner supply opening is located inside the developing frame;

wherein, in a state where the toner supply pipe is located at the inside position, the toner supply opening is located at a downstream side of the seal member in a first direction in which the toner supply pipe moves from the outside position to the inside position;

wherein the toner cartridge further comprises a first shutter provided at the toner supply pipe, the first shutter being configured to move relative to the toner supply pipe between an open position at which the toner supply opening is opened and a closed position at which the toner supply opening is closed; and wherein, when the toner cartridge is attached to the process unit, the first shutter moves from the closed position to the open position in a state where the toner supply pipe is located at the inside position.

3. The process unit according to claim 2, wherein the developing unit further comprises a second shutter configured to move relative to the developing frame between an open position at which the insertion opening is opened and a closed position at which the insertion opening is closed.

4. The process unit according to claim 2, wherein the first shutter is configured to move relative to the toner supply pipe in a direction parallel to the first direction when the toner cartridge is attached to the process unit;

wherein the developing unit has a first contact surface that is located at a downstream side of the seal member in the first direction;

wherein the first shutter has a second contact surface that is located at a downstream side of the toner supply opening in the first direction in a state where the first shutter is located at the closed position, the second contact surface being configured to make contact with the first contact surface in order to move the first shutter from the closed position to the open position when the toner supply pipe moves from the outside position to the inside position; and wherein a distance between the first contact surface and a downstream end of the seal member in the first direction is larger than a distance between the second contact surface and an upstream end of the toner supply opening in the first direction in a state where the first shutter is located at the closed position.

5. The process unit according to claim 4, wherein the developing unit comprises a protrusion located inside the developing frame and protruding from the developing frame, the protrusion having a downstream end and an upstream end in the first direction, the protrusion having the first contact surface at the upstream end.

6. The process unit according to claim 5, wherein the toner cartridge comprises a cover configured to cover an outer surface of the toner supply pipe, the cover having a cylindrical shape, the cover having a guide groove extending in the first direction;

wherein the first shutter comprises:

a base located between the toner supply pipe and the cover, the base having a cylindrical shape, the base being configured to move along the outer surface of the toner supply pipe; and a rib protruding from an outer surface of the base, the rib being received in the guide groove of the cover, the rib having a downstream end and an upstream end in the first direction, the rib having the second contact surface at the downstream end.

7. The process unit according to claim 6, wherein the protrusion comprises:

a first protrusion; and a second protrusion located with a space with respect to the first protrusion in an axial direction of the photosensitive drum;

wherein the rib comprises:

a first rib; and a second rib located at an opposite side of the first rib with respect to the base in the axial direction; and wherein the first shutter moves relative to the toner supply pipe in a state where the first protrusion contacts the first rib and where the second protrusion contacts the second rib.

8. The process unit according to claim 1, wherein the toner cartridge comprises a spring configured to press the first shutter located at the open position toward the closed position.

9. The process unit according to claim 1, further comprising:

a photosensitive drum rotatably supported by the main unit, wherein the developing unit is configured to move relative to the photosensitive drum; and wherein, when the developing unit moves relative to the photosensitive drum in a state where the toner cartridge is attached to the process unit and where the toner supply pipe is located at the inside position, the toner supply pipe remains located at the inside position.

10. The process unit according to claim 9, wherein, when the developing unit moves relative to the photosensitive drum in a state where the toner cartridge is attached to the process unit and where the toner supply pipe is located at the inside position, the developing frame moves relative to the toner supply pipe.

11. The process unit according to claim 9, wherein, when the developing unit moves relative to the photosensitive drum in a state where the toner cartridge is attached to the process unit and where the toner supply pipe is located at the inside position, a direction in which the developing unit moves relative to the photosensitive drum is parallel to a direction in which the toner supply pipe moves between the inside position and the outside position.

12. The process unit according to claim 11, wherein the toner supply pipe has a downstream end in a first direction in which the toner supply pipe moves from the outside position to the inside position; and wherein the developing frame has an inner surface that faces the downstream end of the toner supply pipe with a space therebetween in a state where the toner cartridge is attached to the process unit.

13. The process unit according to claim 9, wherein the main unit has an elongated hole;

wherein the developing unit comprises a boss inserted in the elongated hole; and wherein, when the developing unit moves relative to the photosensitive drum in a state where the toner cartridge is attached to the process unit and where the toner supply pipe is located at the inside position, the boss is guided by the elongated hole.

14. The process unit according to claim 13, wherein the developing roller comprises a shaft extending along a rotation axis of the developing roller;

wherein the boss extends along the rotation axis of the developing roller, the boss having a cylindrical shape; and wherein the shaft is inserted in the boss and is configured to rotate relative to the boss.

15. The process unit according to claim 1, wherein the toner cartridge comprises a flexible screw arranged inside the toner supply pipe and configured to convey toner inside the toner supply pipe toward the toner supply opening, the flexible screw being configured to deform elastically in a direction in which the toner supply pipe extends; and wherein the first shutter located at the open position is pressed toward the closed position by elastic force of the flexible screw.

16. The process unit according to claim 1, wherein the main unit comprises:

a cleaner configured to remove toner from the photosensitive drum; and a cleaning frame configured to accommodate toner removed from the photosensitive drum by the cleaner;

wherein the toner cartridge comprises a toner recovery box configured to recover toner accommodated in the cleaning frame, the toner recovery box having a toner recovery opening; and wherein the main unit comprises a toner recovery pipe configured to recover toner from the cleaning frame to the toner recovery box, the toner recovery pipe having a toner discharge opening in communication with the toner recovery opening in a state where the toner cartridge is attached to the process unit.

17. A toner cartridge attachable to a process unit, comprising:

a toner accommodation box configured to store toner;

a toner supply pipe having:

a toner supply opening configured to supply toner stored in the toner accommodation box to the process unit; and a shutter provided at the toner supply pipe, the shutter being configured to move along the toner supply pipe between an open position at which at least a part of the toner supply opening is not covered by the shutter and a closed position at which the toner supply opening is covered by the shutter, the shutter being configured to move relative to the toner supply pipe from the closed position to the open position when the toner cartridge is attached to the process unit.

* * * * *